US009830867B2

(12) United States Patent
Takasaki et al.

(10) Patent No.: US 9,830,867 B2
(45) Date of Patent: Nov. 28, 2017

(54) DISPLAY DEVICE AND DISPLAY DEVICE DRIVE METHOD

(71) Applicant: Japan Display Inc., Tokyo (JP)

(72) Inventors: Naoyuki Takasaki, Tokyo (JP); Tsutomu Harada, Tokyo (JP); Susumu Kimura, Tokyo (JP)

(73) Assignee: Japan Display Inc., Tokyo (JP)

( * ) Notice: Subject to any disclaimer, the term of this patent is extended or adjusted under 35 U.S.C. 154(b) by 50 days.

(21) Appl. No.: 14/697,820

(22) Filed: Apr. 28, 2015

(65) Prior Publication Data

US 2015/0317934 A1 Nov. 5, 2015

(30) Foreign Application Priority Data

Apr. 30, 2014 (JP) ..... 2014-093368

(51) Int. Cl.
*G09G 3/34* (2006.01)

(52) U.S. Cl.
CPC ..... *G09G 3/3426* (2013.01); *G09G 3/3413* (2013.01); *G09G 2320/062* (2013.01); *G09G 2320/0626* (2013.01); *G09G 2320/0646* (2013.01); *G09G 2360/16* (2013.01)

(58) Field of Classification Search
CPC ..... G09G 3/3426; G09G 3/3413; G09G 2320/062; G09G 2320/0626; G09G 2360/16; G09G 2320/0646
See application file for complete search history.

(56) References Cited

U.S. PATENT DOCUMENTS

2009/0135625 A1 5/2009 Yang et al.
2011/0316829 A1* 12/2011 Oka ..... G09G 3/3426 345/207
2012/0139885 A1* 6/2012 Iwasa ..... G09G 3/3426 345/207
2012/0188217 A1 7/2012 Hasegawa
2013/0027438 A1* 1/2013 Hu ..... G09G 3/3413 345/690
2013/0314458 A1* 11/2013 Murai ..... G09G 3/3406 345/691

FOREIGN PATENT DOCUMENTS

JP 2009-129317 6/2009
JP 2012-155043 8/2012

* cited by examiner

*Primary Examiner* — Aneeta Yodichkas
(74) *Attorney, Agent, or Firm* — K&L Gates LLP

(57) ABSTRACT

A display device includes an image display panel whose display is controlled by an image signal, a backlight which includes light sources and lights the image display panel from behind, and a display control section which calculates, based on the image signal, the required luminance value of the backlight for each divided area of the image display panel, calculates a tentative lighting level of each light source based on luminance distribution information for the backlight stored previously and the required luminance values, sets the lighting level of a first light source whose tentative lighting level exceeds an upper limit to the upper limit, determines the lighting level of a second light source whose tentative lighting level does not exceed the upper limit, based on the lighting level of the first light source, luminance distribution information, and required luminance value, and controls the backlight by the lighting levels.

6 Claims, 19 Drawing Sheets

FIG. 10

70 TENTATIVE LIGHTING LEVEL INFORMATION

| LIGHT SOURCE | L1 | L2 | L3 | L4 | L5 | L6 | L7 | L8 | L9 | L10 |
|---|---|---|---|---|---|---|---|---|---|---|
| LIGHTING RATE (%) | 6 | 6 | 6 | 6 | 6 | 6 | 6 | 100 | 97 | 6 |
| PWM RATIO | 0.12 | 0.12 | 0.12 | 0.12 | 0.12 | 0.12 | 0.12 | 2.00 | 1.94 | 0.12 |

FIG. 15

71 LIGHTING LEVEL INFORMATION

| LIGHT SOURCE | L1 | L2 | L3 | L4 | L5 | L6 | L7 | L8 | L9 | L10 |
|---|---|---|---|---|---|---|---|---|---|---|
| LIGHTING RATE (%) | 6 | 6 | 6 | 6 | 6 | 6 | 52 | 62.5 | 62.5 | 62.5 |
| PWM RATIO | 0.12 | 0.12 | 0.12 | 0.12 | 0.12 | 0.12 | 1.04 | 1.24 | 1.24 | 1.08 |

DISPLAY DEVICE AND DISPLAY DEVICE DRIVE METHOD

CROSS REFERENCES TO RELATED APPLICATIONS

The present application claims priority to Japanese Priority Patent Application JP 2014-093368 filed in the Japan Patent Office on Apr. 30, 2014, the entire content of which is hereby incorporated by reference.

BACKGROUND

The embodiments discussed herein are related to a display device and a display device drive method.

In recent years the technique of division drive control in a backlight is known as a technique for reducing the power consumption of a display device. Such division drive control in a backlight is performed by adjusting a lighting level of each light source included in the backlight. Accordingly, a light source used at a high luminance value with great frequency deteriorates more rapidly than another light source. As a result, the lifetime of an entire display device shortens. In order to solve this problem, a technique for lengthening the lifetime of a light source is proposed (see, for example, Japanese Laid-open Patent Publication No. 2012-155043).

SUMMARY

There are provided a display device and a display device drive method which reduce the deterioration of a light source.

According to an aspect, there is provided a display device including an image display panel whose display is controlled on the basis of an image signal, a backlight which includes a plurality of light sources and which lights the image display panel from behind, and a display control section which calculates on the basis of the image signal a required luminance value of the backlight for an area obtained by dividing a display surface of the image display panel, which calculates a tentative lighting level of each of the plurality of light sources on the basis of luminance distribution information for the backlight stored in advance and the required luminance value, which sets a lighting level of a first light source whose tentative lighting level exceeds a determined upper limit value to the upper limit value, which calculates and determines a lighting level of a second light source whose tentative lighting level does not exceed the upper limit value on the basis of the lighting level of the first light source, the luminance distribution information, and the required luminance value, and which controls the backlight by the lighting levels.

The object and advantages of the invention will be realized and attained by means of the elements and combinations particularly pointed out in the claims.

It is to be understood that both the foregoing general description and the following detailed description are exemplary and explanatory and are not restrictive of the invention.

Additional features and advantages are described herein, and will be apparent from the following Detailed Description and the figures.

BRIEF DESCRIPTION OF THE FIGURES

FIG. 10 illustrates an example of tentative lighting level information;

FIG. 15 illustrates an example of lighting level information;

DETAILED DESCRIPTION

Figure 1:
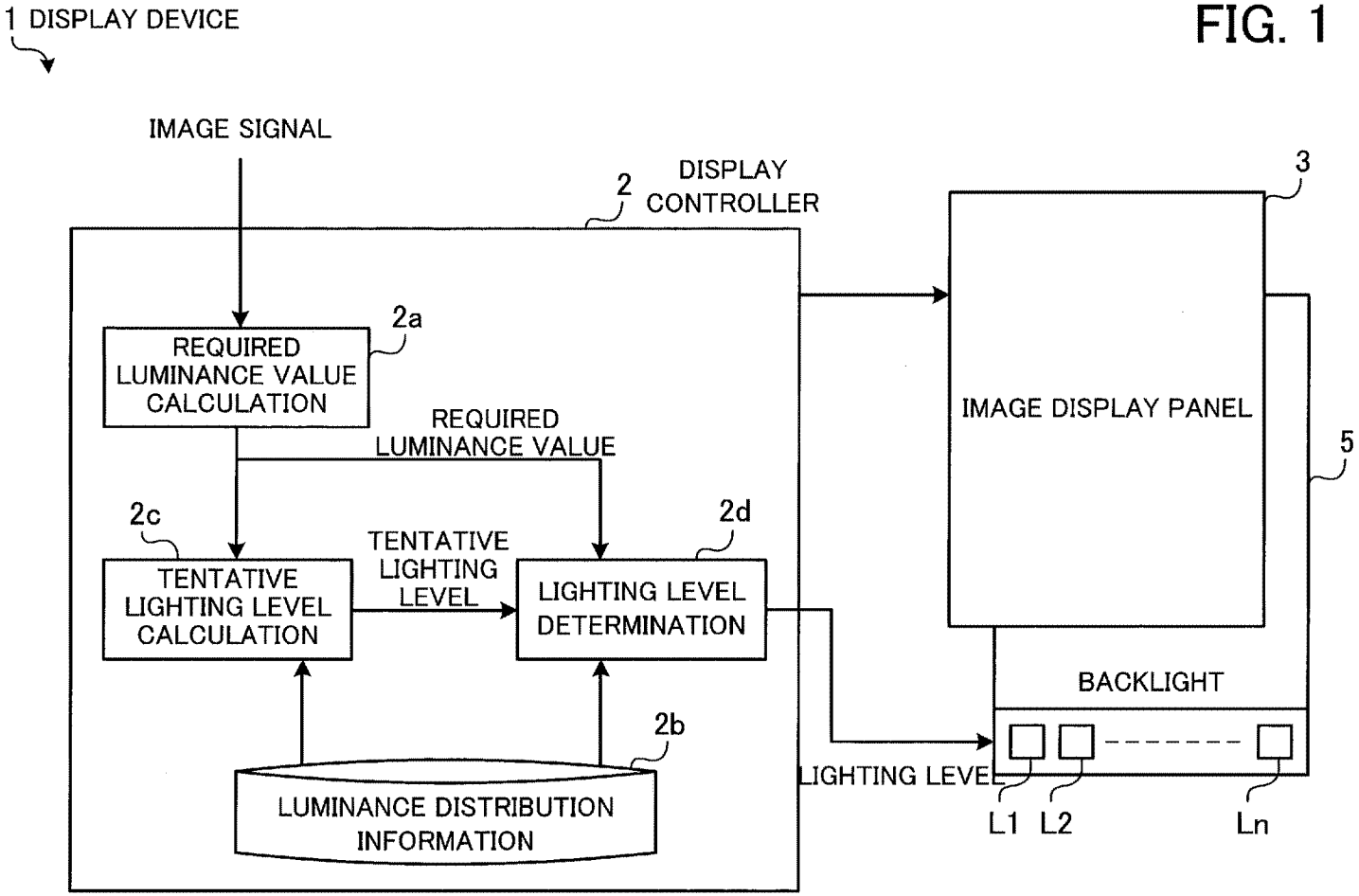
FIG. 1 illustrates an example of the structure of a display device according to a first embodiment.

Embodiments will now be described with reference to the accompanying drawings, wherein like reference numerals refer to like elements throughout.

Disclosed embodiments are just examples. It is a matter of course that a proper change which suits the spirit of the invention and which will readily occur to those skilled in the art falls within the scope of the present invention. Furthermore, in order to make description clearer, the width, thickness, shape, or the like of each component may schematically be illustrated in the drawings compared with the real state. However, it is a simple example and the interpretation of the present invention is not restricted.

In addition, in the present invention and the drawings the same components that have already been described in previous drawings are marked with the same numerals and detailed descriptions of them may be omitted according to circumstances.

First Embodiment

A display device according to a first embodiment will be described by the use of FIG. 1. FIG. 1 illustrates an example of the structure of a display device according to a first embodiment.

A display device 1 illustrated in FIG. 1 includes a display controller 2, an image display panel 3, and a backlight 5.

The display controller 2 includes a storage section which stores luminance distribution information 2*b* in advance, performs required luminance value calculation 2*a*, tentative lighting level calculation 2*c*, and lighting level determination 2*d*, and controls the luminance of the backlight 5.

The image display panel 3 includes (P×Q) pixels arranged in a matrix. The image display panel 3 displays an image on the display surface on the basis of an image signal.

The backlight 5 includes a plurality of light sources L1, L2, . . . , and Ln and lights the image display panel 3 from behind. When there is no need to distinguish among the light sources L1, L2, . . . , and Ln, the term "light sources L" will be employed in the following description. The light sources L operate independently of one another and a lighting level is set for each light source L. The backlight 5 emits, for example, white light from an emission surface opposite the display surface of the image display panel 3 to the display surface. Furthermore, in the backlight 5 division drive control by which a lighting level of each light source L is adjusted for controlling luminance according to divided areas is performed.

Each step performed by the display controller 2 and the luminance distribution information 2*b* will be described.

In the required luminance value calculation 2*a*, the display controller 2 acquires an image signal and calculates on the basis of the image signal a required luminance value of the backlight 5 for a divided area obtained by dividing the display surface of the image display panel 3. A required luminance value is lowest luminance at which all pixels in a divided area of the image display panel 3 can reproduce color. Furthermore, a required luminance value is calculated for each divided area.

The luminance distribution information 2*b* is information for the distribution of luminance values of the backlight 5 obtained at the time of lighting each light source L at a determined lighting level. The luminance distribution information 2*b* is generated in advance and is stored in the storage section.

In the tentative lighting level calculation 2*c*, the display controller 2 calculates a tentative lighting level of a light source L on the basis of a required luminance value and the luminance distribution information 2*b*. A required luminance value is determined for each divided area. In the tentative lighting level calculation 2*c*, the display controller 2 calculates on the basis of the luminance distribution information 2*b* a tentative lighting level of a light source L which satisfies a required luminance value for each divided area.

In the lighting level determination 2*d*, the display controller 2 calculates a lighting level of a light source L on the basis of a tentative lighting level of the light source L, a required luminance value for each divided area, and the luminance distribution information 2*b*. In particular, the display controller 2 compares a tentative lighting level of a light source L with a specified upper limit value determined in advance. If a tentative lighting level of a first light source exceeds the upper limit value, then a lighting level of the first light source is set to the upper limit value. If a tentative lighting level of a second light source does not exceed the upper limit value, then a lighting level of the second light source is set on the basis of the lighting level of the first light source, a required luminance value, and the luminance distribution information 2*b*. The upper limit value set is in the range between a lighting level which does not cause the luminance below the maximum luminance obtained by an image signal and a lighting level corresponding to a peak value of drive current by which a light source L is driven. The lighting level of the first light source is limited to the upper limit value which is lower than the tentative lighting level of the first light source, so the luminance of the backlight 5 for a corresponding divided area is lower than a required luminance value. Accordingly, a reduction in luminance is compensated for by increasing a lighting level of the second light source whose tentative lighting level does not exceed the upper limit value. The display controller 2 determines in this way lighting levels of plural light sources L which satisfy a required luminance value for a divided area, and controls the luminance of the backlight 5 by the determined lighting levels. The first light source or the second light source merely indicates the state of a light source L. Each light source L goes into one of the two states according to a required luminance value for a corresponding block.

With the display device 1 having the above structure, display control of the image display panel 3 and division drive control of the backlight 5 by the display controller 2 are performed on the basis of an image signal. The display controller 2 analyzes the image signal according to divided areas, calculates a required luminance value, and calculates a tentative lighting level of a light source L which satisfies the required luminance value. If a tentative lighting level of a first light source exceeds an upper limit value, then a lighting level of the first light source is limited to the upper limit value. If a tentative lighting level of a second light source does not exceed the upper limit value, then a lighting level of the second light source is determined so that a reduction in the luminance of the backlight 5 caused by limiting a lighting level of the first light source will be compensated for. The maximum value of a lighting level of a light source L is limited in this way to the upper limit value, so the deterioration of the light source L caused by driving it at a large lighting level is reduced. Furthermore, a reduction in the luminance of the backlight 5 caused by limiting a lighting level of a light source L is compensated for by another light source L, so image quality does not degrade.

Second Embodiment

A display device according to a second embodiment will now be described. First the structure of a display device will be described, and then a process performed by the display device will be described.

Figure 2:
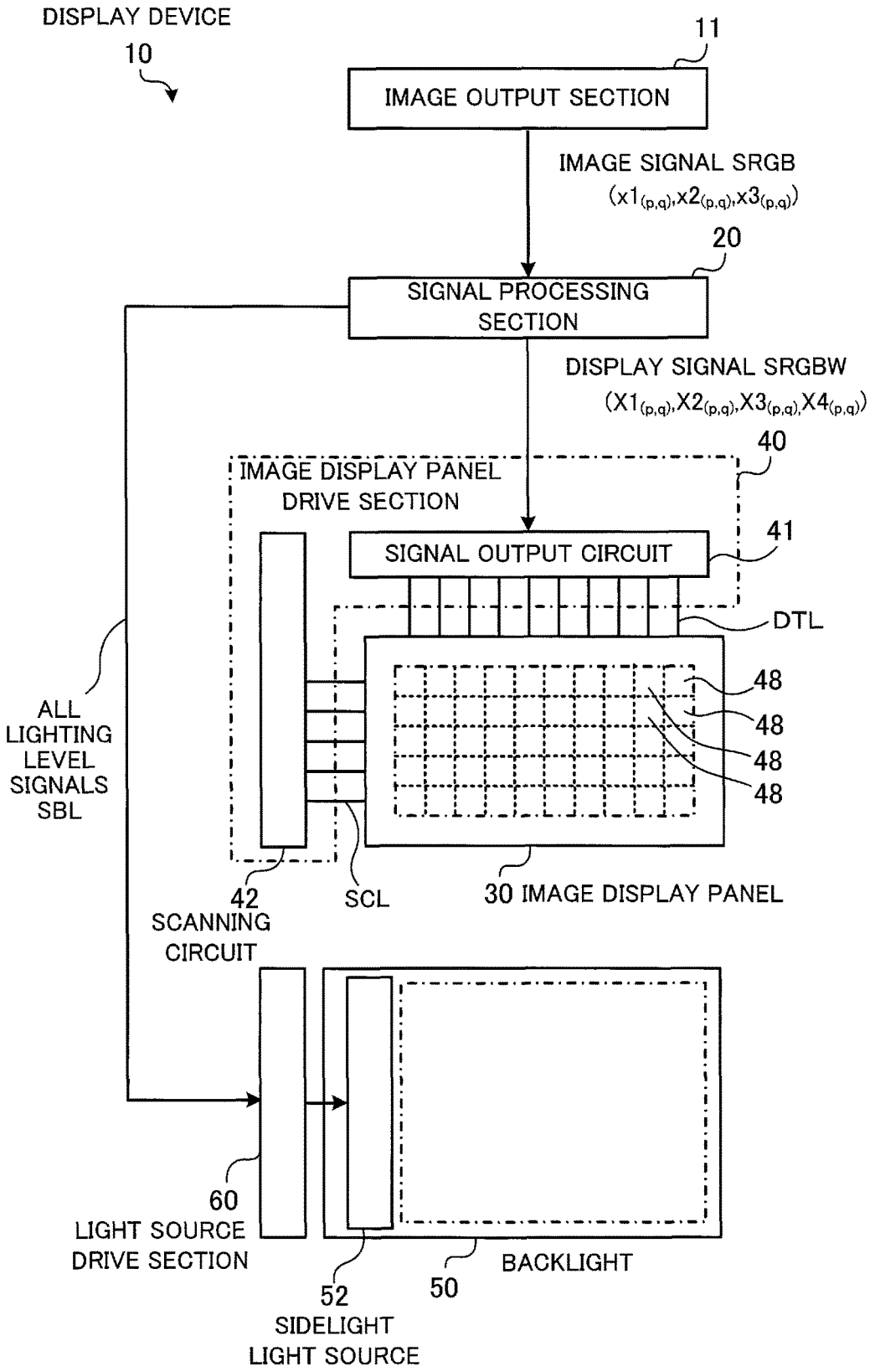
FIG. 2 illustrates an example of the structure of a display device according to a second embodiment.

FIG. 2 illustrates an example of the structure of a display device according to a second embodiment.

A display device 10 illustrated in FIG. 2 includes an image output section 11, a signal processing section 20, an image display panel 30, an image display panel drive section 40, a backlight 50, and a light source drive section 60. The display device 10 is an embodiment of the display device 1 illustrated in FIG. 1.

The image output section 11 outputs an image signal SRGB to the signal processing section 20. The image signal SRGB includes an image signal value $x1_{(p,q)}$ for a first primary color, an image signal value $x2_{(p,q)}$ for a second primary color, and an image signal value $x3_{(p,q)}$ for a third primary color. In the second embodiment it is assumed that the first primary color is red, that the second primary color is green, and that the third primary color is blue.

The signal processing section 20 is connected to the image display panel drive section 40 which drives the image display panel 30 and is connected to the light source drive section 60 which drives the backlight 50. The signal processing section 20 converts the image signal SRGB to a display signal SRGBW and outputs the display signal SRGBW to the image display panel drive section 40. In addition to a display signal value $X1_{(p,q)}$ corresponding to a first subpixel, a display signal value $X2_{(p,q)}$ corresponding to a second subpixel, and a display signal value $X3_{(p,q)}$ corresponding to a third subpixel, the display signal SRGBW includes a display signal value $X4_{(p,q)}$ corresponding to a fourth subpixel which displays a fourth color. In the second embodiment it is assumed that the fourth color is white, for example. Furthermore, the signal processing section 20 generates all lighting level signals SBL, which are control signals for division-driving the backlight 50, on the basis of the image signal SRGB and outputs the all lighting level signals SBL to the light source drive section 60. The signal processing section 20 is an embodiment of the display controller 2.

The image display panel 30 includes (P×Q) pixels 48 arranged in a two-dimensional matrix. The image display panel drive section 40 includes a signal output circuit 41 and a scanning circuit 42 and performs display control of the image display panel 30 on the basis of the display signal SRGBW.

The backlight 50 is arranged on the rear side of the image display panel 30 and emits light to the image display panel 30. By doing so, the backlight 50 lights the image display panel 30. Furthermore, the backlight 50 includes a sidelight light source 52 on a side of its display surface. The sidelight light source 52 includes a plurality of light sources which operate independently of one another. As a result, division drive control of the backlight 50 is performed. The light source drive section 60 performs division drive control of the backlight 50 on the basis of the all lighting level signals SBL outputted from the signal processing section 20. The all lighting level signals SBL indicate lighting levels calculated for the plurality of light sources included in the sidelight light source 52.

Figure 3:
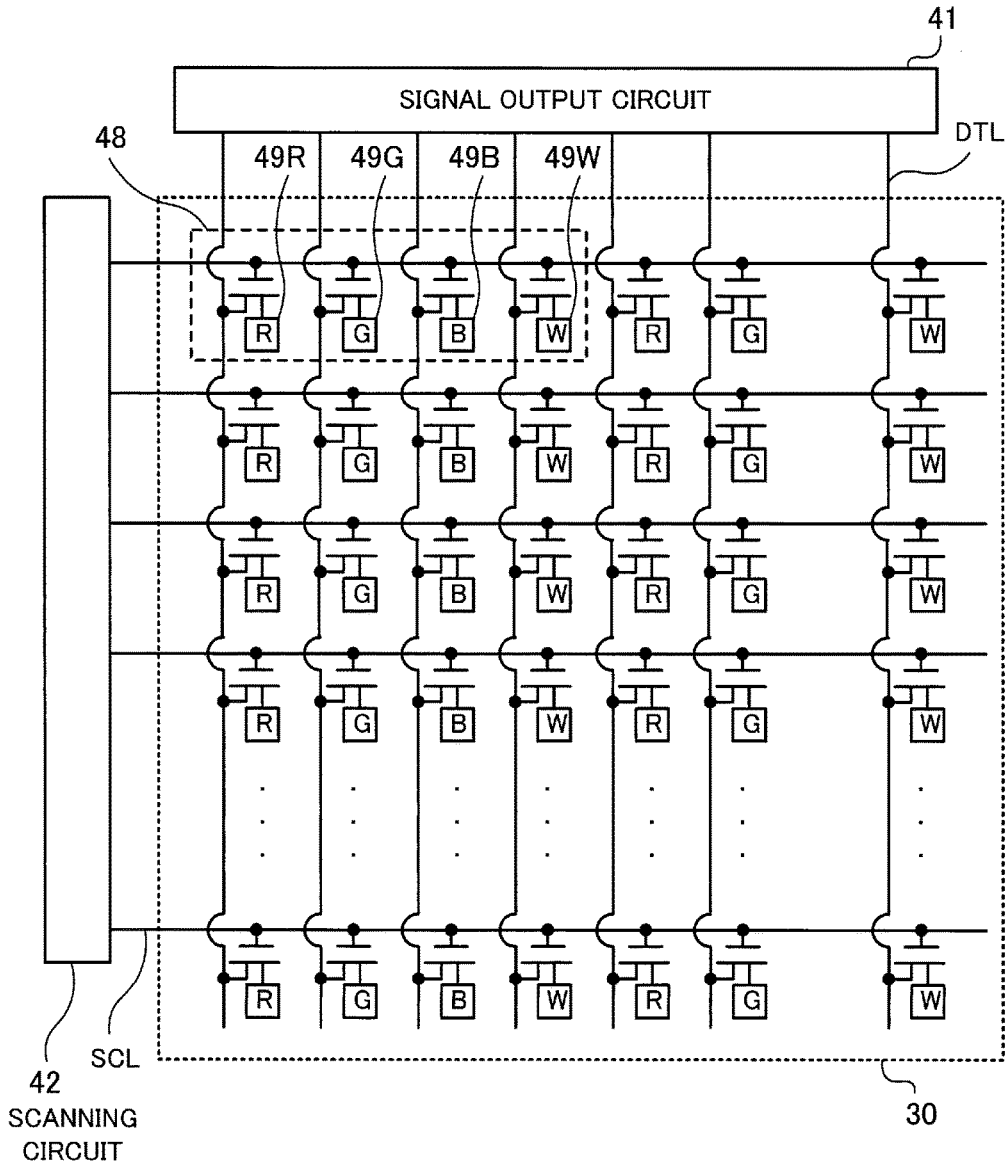
FIG. 3 illustrates an example of the arrangement of pixels on an image display panel in the second embodiment.

The image display panel 30 and the backlight 50 will now be described by the use of FIGS. 3 and 4 respectively. The image display panel 30 will be described first. FIG. 3 illustrates an example of the arrangement of pixels on the image display panel in the second embodiment.

With the image display panel 30 illustrated in FIG. 3, each of the pixels 48 arranged in a two-dimensional matrix includes a first subpixel 49R, a second subpixel 49G, a third subpixel 49B, and a fourth subpixel 49W. In the second embodiment, the first subpixel 49R displays red, the second subpixel 49G displays green, the third subpixel 49B displays blue, and the fourth subpixel 49W displays white. However, colors of the first subpixel 49R, the second subpixel 49G, and the third subpixel 49B are not limited to them. The first subpixel 49R, the second subpixel 49G, and the third subpixel 49B may display other different colors. For example, the first subpixel 49R, the second subpixel 49G, and the third subpixel 49B may display the complementary colors of red, green, and blue respectively. Furthermore, a color of the fourth subpixel 49W is not limited to white. For example, the fourth subpixel 49W may display yellow. However, white is effective in reducing power consumption. It is desirable that if the first subpixel 49R, the second subpixel 49G, the third subpixel 49B, and the fourth subpixel 49W are lighted at the same lighting level, the fourth subpixel 49W be brighter than the first subpixel 49R, the second subpixel 49G, and the third subpixel 49B. If there is no need to distinguish among the first subpixel 49R, the second subpixel 49G, the third subpixel 49B, and the fourth subpixel 49W, then the term "subpixels 49" will be employed in the following description.

The signal output circuit 41 and the scanning circuit 42 included in the image display panel drive section 40 are electrically connected to the subpixels 49R, 49G, 49B, and 49W of the image display panel 30 via signal lines DTL and scanning lines SCL respectively. The subpixels 49 are connected not only to the signal lines DTL but also to the scanning lines SCL via switching elements (such as thin film transistors (TFTs)). The image display panel drive section 40 selects subpixels 49 by the scanning circuit 42 and outputs image signals in order from the signal output circuit 41. By doing so, the image display panel drive section 40 controls the operation (light transmittance) of the subpixels 49.

The backlight 50 will now be described by the use of FIG. 4. FIG. 4 illustrates an example of the structure of the backlight in the second embodiment.

Figure 4:
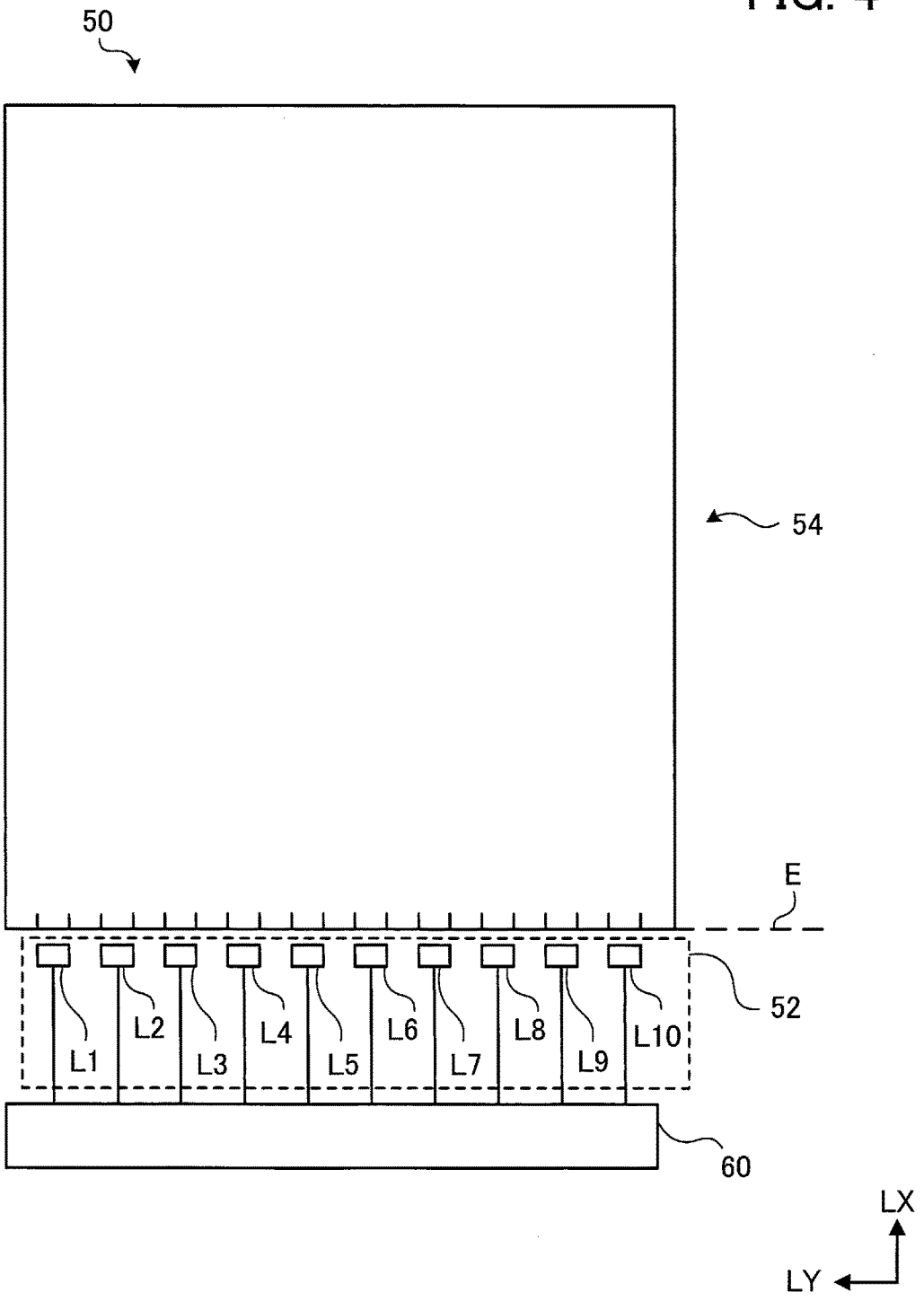
FIG. 4 illustrates an example of the structure of a backlight in the second embodiment.

The backlight 50 illustrated in FIG. 4 includes a light guide plate 54 and the sidelight light source 52 in which light sources L1, L2, L3, L4, L5, L6, L7, L8, L9, and L10 are arranged opposite an incident surface E that is at least one side of the light guide plate 54. The light sources L1, L2, L3, L4, L5, L6, L7, L8, L9, and L10 are light-emitting diodes (LEDs) which emit light of the same color (white, for example), and control current values or duty ratios independently of one another. If there is no need to distinguish among the light sources L1, L2, L3, L4, L5, L6, L7, L8, L9, and L10, then the term "light sources L" will be employed in the following description. The light sources L are arranged along the one side of the light guide plate 54. It is assumed that the direction in which the light sources L are arranged is a light source arrangement direction LY. Light emitted from the light sources L is inputted from the incident surface E to the light guide plate 54 in an incident direction LX intersect or perpendicular to the light source arrangement direction LY. Furthermore, light which enters the light guide plate 54 is emitted from a surface opposite the image display panel 30. Lights which are emitted from the light sources L and which are emitted from the light guide plate 54 to the rear of the image display panel 30 have different luminance distributions according to the positions at which the light sources L are arranged.

The light source drive section 60 adjusts the values of current supplied to the light sources L or duty ratios on the basis of all lighting level signals SBL outputted from the signal processing section 20. By doing so, the light source drive section 60 controls the amounts of the lights of the light sources L and controls the luminance (intensity of the light) of the backlight 50.

Figure 5:
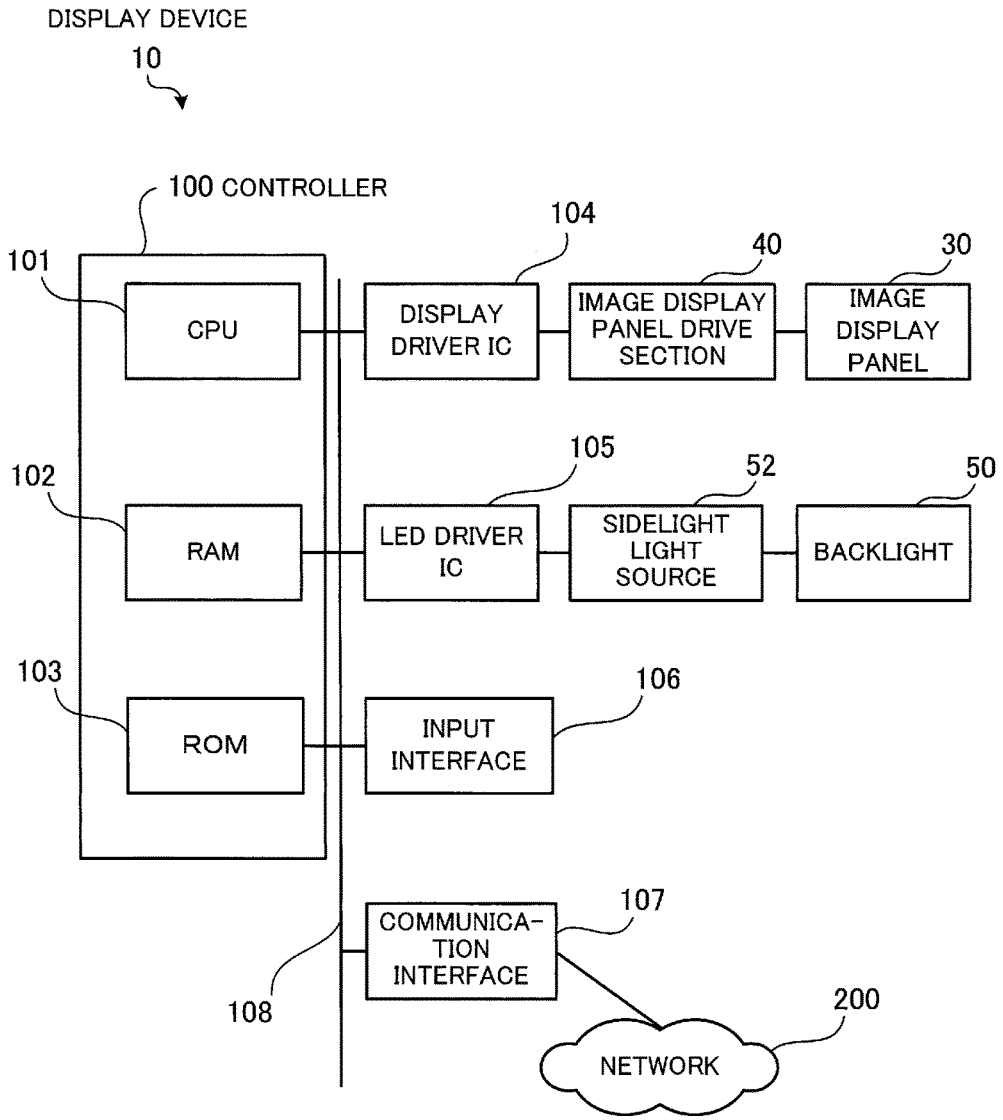
FIG. 5 illustrates an example of the hardware configuration of the display device according to the second embodiment.

The hardware configuration of the display device 10 will now be described. FIG. 5 illustrates an example of the hardware configuration of the display device according to the second embodiment.

The whole of the display device 10 is controlled by a controller 100. The controller 100 includes a central processing unit (CPU) 101. A random access memory (RAM) 102, a read only memory (ROM) 103, and a plurality of peripheral units are connected to the CPU 101 via a bus 108.

The CPU 101 is a processor which realizes the processing functions of the controller 100.

The RAM 102 is used as main storage of the controller 100. The RAM 102 temporarily stores at least a part of an operating system (OS) program or an application program executed by the CPU 101. In addition, the RAM 102 stores various pieces of data which the CPU 101 needs to perform a process.

The ROM 103 is a read only semiconductor memory and stores an OS program, an application program, and fixed data which is not rewritten. Furthermore, a semiconductor memory, such as a flash memory, may be used as auxiliary storage in place of the ROM 103 or in addition to the ROM 103.

The plurality of peripheral units connected to the bus 108 are a display driver integrated circuit (IC) 104, an LED driver IC 105, an input interface 106, and a communication interface 107.

The image display panel drive section 40 is connected to the display driver IC 104. The display driver IC 104 outputs a display signal SRGBW to the image display panel drive section 40 to display an image on the image display panel 30.

The sidelight light source 52 is connected to the LED driver IC 105. The LED driver IC 105 drives the sidelight light source 52 by all lighting level signals SBL and controls the luminance of the backlight 50.

An input device used for inputting a user's instructions is connected to the input interface 106. An input device, such as a keyboard, a mouse used as a pointing device, or a touch panel, is connected. The input interface 106 transmits to the CPU 101 a signal transmitted from the input device.

The communication interface 107 is connected to a network 200. The communication interface 107 transmits data to or receives data from another computer or a communication apparatus via the network 200.

By adopting the above hardware configuration, the processing functions in the second embodiment are realized. The above hardware configuration is an example and is changed according to circumstances.

The processing functions of the signal processing section 20 illustrated in FIG. 2 are realized by the controller 100 or the display driver IC 104.

If the processing functions of the signal processing section 20 are realized by the display driver IC 104, then an image signal SRGB is inputted to the display driver IC 104 via the CPU 101. The display driver IC 104 converts the image signal SRGB to a display signal SRGBW and controls the image display panel 30. In addition, the display driver IC 104 generates all lighting level signals SBL and outputs them to the LED driver IC 105 via the bus 108.

If the processing functions of the signal processing section 20 are realized by the CPU 101, then a display signal SRGBW is inputted from the CPU 101 to the display driver IC 104. All lighting level signals SBL are also generated by the CPU 101 and are transmitted to the LED driver IC 105 via the bus 108.

Figure 6:
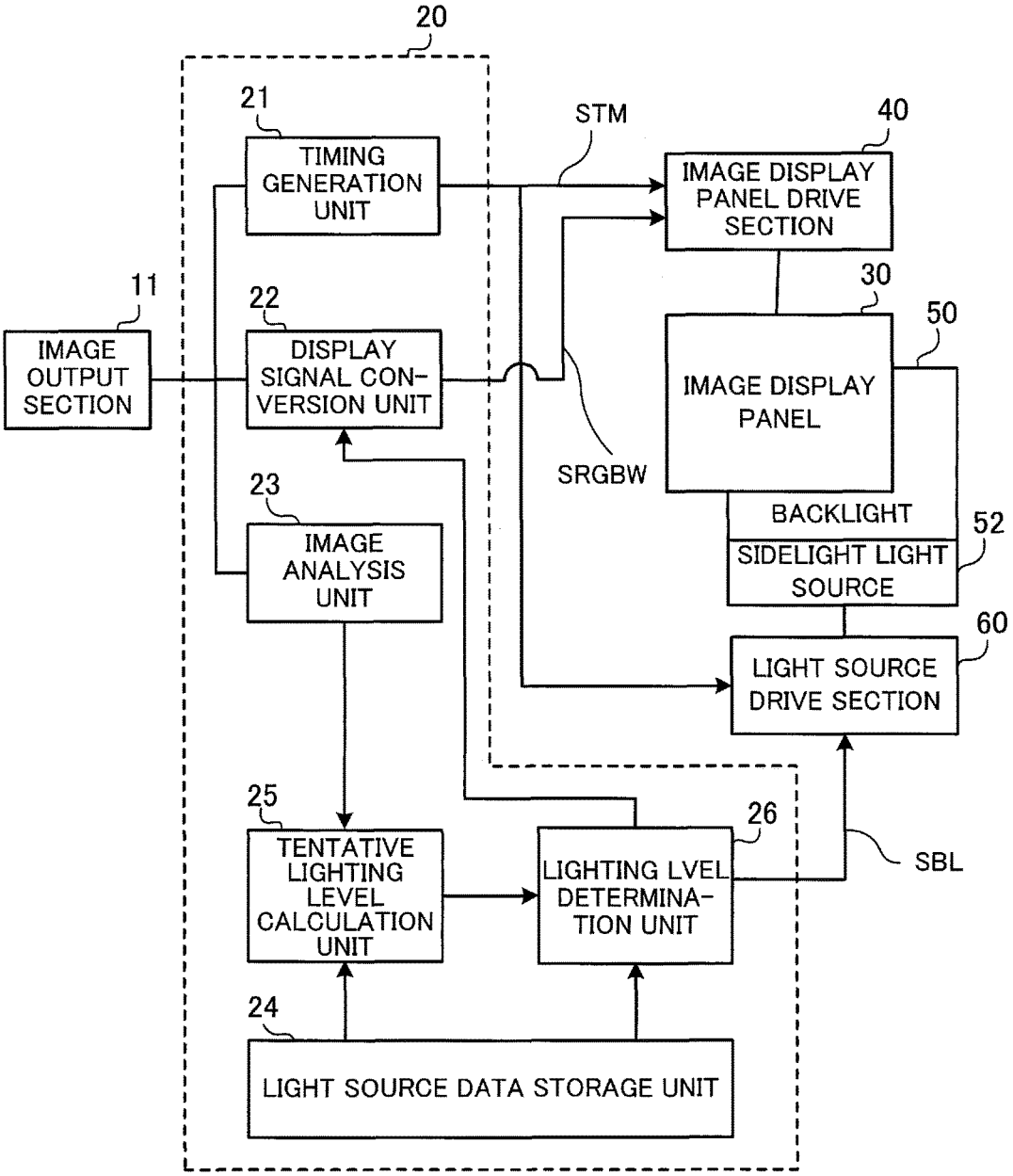
FIG. 6 is a functional block diagram of a signal processing section in the second embodiment.

The structure of the functions of the signal processing section 20 will now be described. FIG. 6 is a functional block diagram of the signal processing section in the second embodiment.

The signal processing section 20 includes a timing generation unit 21, a display signal conversion unit 22, an image analysis unit 23, a light source data storage unit 24, a tentative lighting level calculation unit 25, and a lighting level determination unit 26. An image signal SRGB is inputted from the image output section 11 to the signal processing section 20. The image signal SRGB includes color information for an image displayed at the position of each pixel 48.

The timing generation unit 21 generates a synchronization signal STM every image display frame for synchronizing the operation timing of the image display panel drive section 40 with that of the light source drive section 60. The timing generation unit 21 outputs the generated synchronization signal STM to the image display panel drive section 40 and the light source drive section 60.

The display signal conversion unit 22 calculates, on the basis of the color information included in the image signal SRGB, a conversion coefficient for converting the image signal SRGB to a display signal SRGBW, and uses the conversion coefficient for converting the image signal SRGB to a display signal SRGBW. In addition, the display signal conversion unit 22 corrects the display signal SRGBW on the basis of luminance information for the backlight 50 inputted from the lighting level determination unit 26.

On the basis of the image signal SRGB, the image analysis unit 23 calculates a required luminance value of the backlight 50 required for each divided area obtained by dividing a display surface of the image display panel 30. In the following description each divided area will be referred to as a block. Any way may be adopted to divide the display surface and form blocks. With division drive control of the backlight 50 the luminance of the backlight 50 is adjusted according to an image to be displayed. Accordingly, the image analysis unit 23 analyzes the image signal SRGB corresponding to a block and calculates a required luminance value required for displaying an image. For example, a conversion coefficient for converting the image signal SRGB to a display signal SRGBW is calculated on the basis of color information for the first primary color, the second primary color, and the third primary color included in the image signal SRGB, and a required luminance value is calculated on the basis of the conversion coefficient.

The light source data storage unit 24 stores various pieces of information referred to in the signal processing section 20. A luminance value of a representative pixel which represents pixels included in a determined area obtained by dividing the display surface is recorded in a tabular form in luminance distribution information by light source included in the various pieces of information. In the following description luminance distribution information by light source in a tabular form will be referred to as a light-source-specific lookup table (LUT). An light-source-specific LUT is information specific to the display device 10, so it is created in advance and is stored in the light source data storage unit 24.

Figure 7:
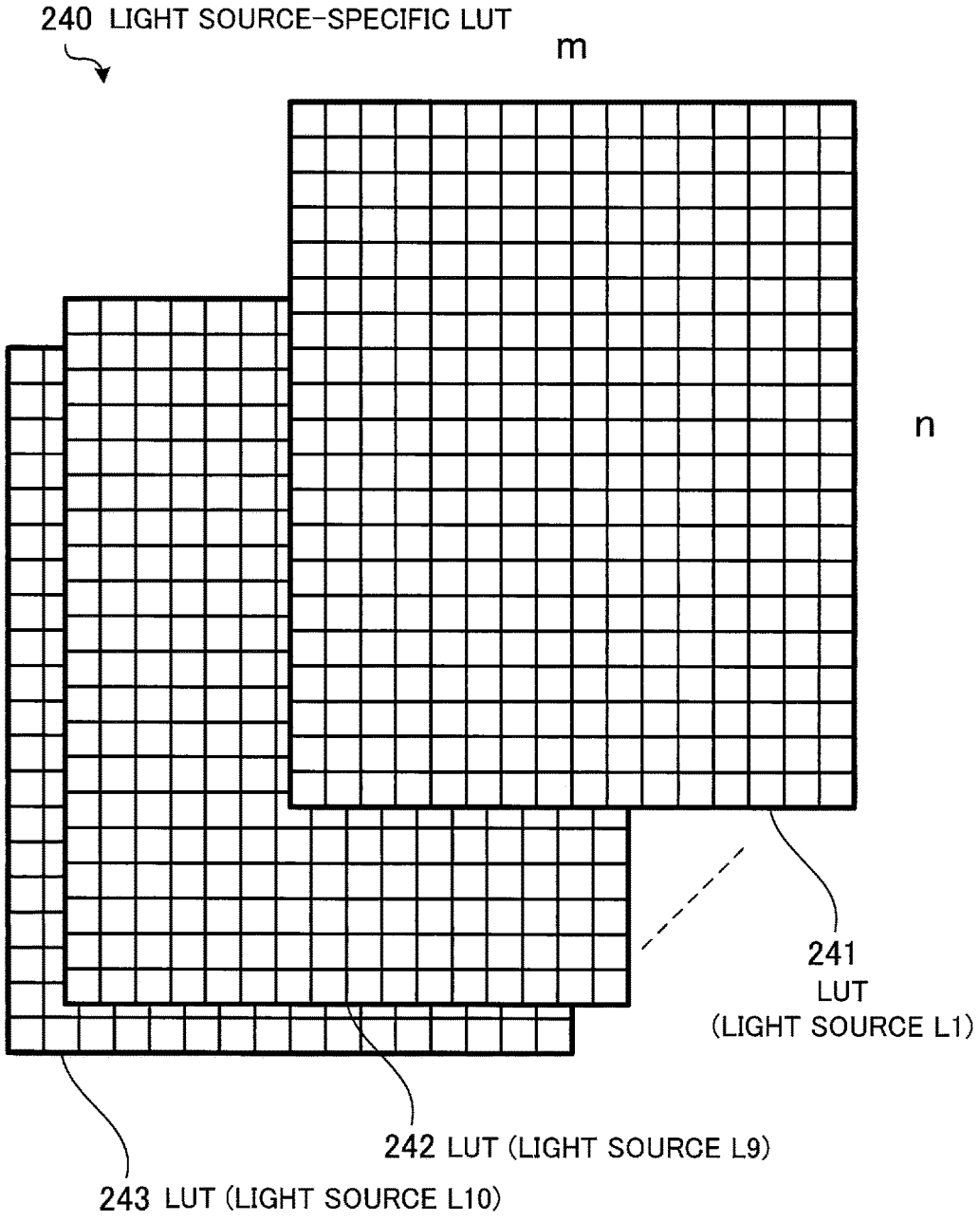
FIG. 7 illustrates light-source-specific LUTs in the second embodiment.

FIG. 7 illustrates light-source-specific LUTs in the second embodiment.

A light-source-specific LUT 240 is prepared for each of the light sources L1 through L10. Luminance values of representative pixels of (m×n) areas obtained by dividing the display surface at the time of lighting only the light source L1 at a determined lighting level are recorded in a tabular form in an LUT 241. The LUT 241 for the light source L1 through an LUT 243 for the light source L10 are created in this way and are stored in the light source data storage unit 24. If a luminance value of a representative pixel which represents each area is registered in the light-source-specific LUT 240, the size of the light-source-specific LUT 240 is small compared with a case where luminance values of all pixels in each area are registered. As a result, the storage capacity of the light source data storage unit 24 is reduced. When a luminance value of each pixel is needed, it is calculated by interpolation calculation. The light-source-specific LUT 240 is information at the time of lighting one light source L at a time. However, a light-source-specific LUT at the time of simultaneously lighting a combination of the light sources L1 and L2, a combination of the light sources L3 and L4, or the like may be created and stored. This reduces the amount of work for creating light-source-specific LUTs and the storage capacity of the light source data storage unit 24. A combination of one or more light sources is referred to as a light source unit. The light-source-specific LUT 240 is prepared for each light source unit. Furthermore, a luminance value is set in a corrected state in the light-source-specific LUT 240 so as to accommodate luminance irregularity correction. By using this light-source-specific LUT 240, luminance irregularity correction and lighting level determination are performed at the same time.

Description will return to FIG. 6.

The tentative lighting level calculation unit 25 calculates a tentative lighting level of each light source L of the sidelight light source 52 on the basis of a required luminance value calculated by the image analysis unit 23 and the light-source-specific LUT 240. For example, the tentative lighting level calculation unit 25 tentatively sets a tentative lighting level, calculates the luminance distribution of the entire backlight 50 in that state by the use of the light-source-specific LUT 240, compares the calculated luminance distribution with the required luminance value, and corrects the tentative lighting level. This operation is repeated at need until a tentative lighting level which satisfies the required luminance value is obtained. Alternatively, the tentative lighting level calculation unit 25 may find a tentative lighting level which satisfies the required luminance value by calculation. The tentative lighting level calculation unit 25 outputs the calculated tentative lighting level to the lighting level determination unit 26.

The lighting level determination unit 26 acquires the tentative lighting level of each light source L and compares it with an upper limit value. It is assumed that a light source whose tentative lighting level exceeds the upper limit value at this time is a first light source and that a light source whose tentative lighting level does not exceed the upper limit value at this time is a second light source. If the first light source is not detected, then the tentative lighting level calculated by the tentative lighting level calculation unit 25 is considered as a lighting level. If a first light source is detected, then a lighting level of the detected first light source is set to the upper limit value. If the luminance of a corresponding block becomes lower than a required luminance value by limiting a lighting level of the first light source, then a lighting level of a second light source adjacent to the first light source is increased to compensate for a reduction in the luminance. For example, the lighting level determination unit 26 calculates on the basis of the light-source-specific LUT 240 a lighting level of the second light source by which the reduction in the luminance of the corresponding block is compensated for, and adds this lighting level to a tentative lighting level of the second light source. By doing so, a lighting level of the second light source is calculated. Alternatively, a tentative lighting level calculation may be performed again with a lighting level of the first light source considered to be fixed. If the calculated lighting level of the second light source exceeds the upper limit value, then a lighting level of the second light source is set to the upper limit value. After that, the same process is performed on another second light source adjacent to the second light source. A lighting level correction process is repeated in order on a second light source until the luminance of the corresponding block satisfies the required luminance value. The lighting level determination unit 26 generates in this way all lighting level signals SBL of the light sources L1 through L10 included in the sidelight light source 52 and outputs them to the light source drive section 60. The light source drive section 60 controls the sidelight light source 52 by the all lighting level signals SBL. Furthermore, the lighting level determination unit 26 calculates luminance information for the backlight 50 based on the generated all lighting level signals SBL on the basis of the light-source-specific LUT 240 and outputs the luminance information for the backlight 50 to the display signal conversion unit 22. The display signal conversion unit 22 may correct a display signal SRGBW on the basis of the luminance information for the backlight 50.

The operation of the display device 10 having the above structure will be described.

With the display device 10 each pixel 48 includes the fourth subpixel 49W which outputs the fourth color (white, for example). This extends the dynamic range of a value in reproduction HSV color space which can be reproduced by the display device 10. When the display device 10 generates a display signal SRGBW from an image signal SRGB, the display device 10 improves the luminance of each pixel by using an expansion coefficient $\alpha$ as a conversion coefficient. "H" represents hue, "S" represents saturation, and "V" represents a value.

Figure 8:
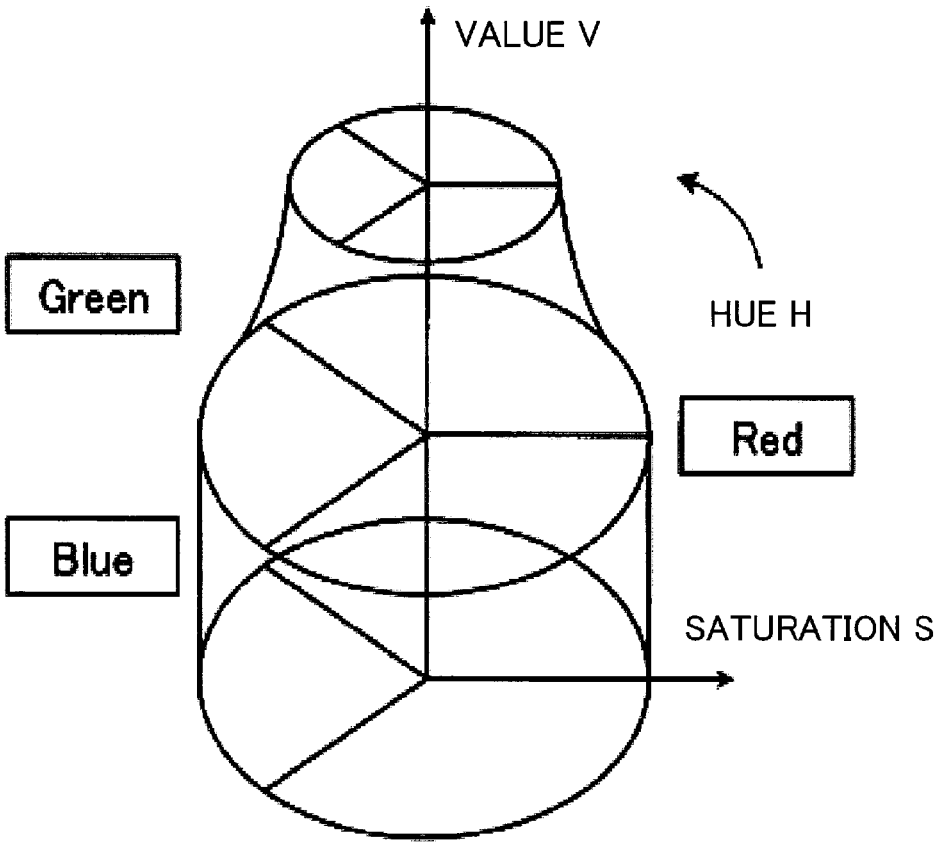
FIG. 8 is a schematic view of reproduction HSV color space which can be reproduced by the display device according to the second embodiment.

FIG. 8 is a schematic view of reproduction HSV color space which can be reproduced by the display device according to the second embodiment. As illustrated in FIG. 8, the reproduction HSV color space to which the fourth color has been added has a shape obtained by putting an approximately trapezoid solid in which, as the saturation S increases, the maximum value of the value V becomes smaller on cylindrical HSV color space which the first subpixel 49R, the second subpixel 49G, and the third subpixel 49B display. The signal processing section 20 stores the maximum value Vmax(S) of a value expressed with the saturation S in the reproduction HSV color space which has been extended by adding the fourth color as a variable. That is to say, the signal processing section 20 stores the maximum value Vmax(S) of a value according to the coordinates (values) of the saturation S and the hue H for the solid shape of the reproduction HSV color space illustrated in FIG. 8.

The image signal SRGB includes image signal values corresponding to the first, second, and third primary colors, so HSV color space of the image signal SRGB has a cylindrical shape, that is to say, has the same shape as a cylindrical portion of the reproduction HSV color space illustrated in FIG. 8 has. Accordingly, the display signal SRGBW is calculated as an expanded image signal obtained by expanding the image signal SRGB to make it fall within the reproduction HSV color space. The image signal SRGB is expanded by the use of the expansion coefficient $\alpha$ determined by comparing the value levels of subpixels of the image signal SRGB in the reproduction HSV color space. By expanding the level of the image signal SRGB by the use of the expansion coefficient $\alpha$, a display signal value corresponding to the fourth subpixel 49W can be made large. This increases the luminance of an entire image. At this time the luminance of the backlight 50 is reduced to $1/\alpha$ according to an increase in the luminance of the entire image caused by expanding by the use of the expansion coefficient $\alpha$. By doing so, display is performed with exactly the same luminance as with the image signal SRGB.

The expansion of an image signal SRGB will now be described.

In the signal processing section 20, a display signal value $X1_{(p,\ q)}$ corresponding to the first subpixel 49R, a display signal value $X2_{(p,\ q)}$ corresponding to the second subpixel 49G, and a display signal value $X3_{(p,\ q)}$ corresponding to the third subpixel 49B for a (p, q)th pixel (or a combination of the first subpixel 49R, the second subpixel 49G, and the third subpixel 49B) are expressed as:

$$X1_{(p,q)}=\alpha\cdot x1_{(p,q)}-\chi\cdot X4_{(p,q)} \quad (1)$$

$$X2_{(p,q)}=\alpha\cdot x2_{(p,q)}-\chi\cdot X4_{(p,q)} \quad (2)$$

$$X3_{(p,q)}=\alpha\cdot x3_{(p,q)}-\chi\cdot X4_{(p,q)} \quad (3)$$

where $\alpha$ is an expansion coefficient and x is a constant which depends on the display device 10. $\chi$ will be described later.

In addition, a display signal value $X4_{(p,q)}$ is calculated on the basis of the product of $Min_{(p,q)}$ and the expansion coefficient $\alpha$, where $Min_{(p,q)}$ is the minimum value of image signal values $x1_{(p,q)}$, $x2_{(p,q)}$, and $x3_{(p,q)}$. To be concrete, a display signal value $X4_{(p,q)}$ is found on the basis of $$X4_{(p,q)}=Min_{(p,q)}\cdot\alpha/\chi \quad (4)$$

In expression (4), the product of $Min_{(p,q)}$ and the expansion coefficient $\alpha$ is divided by $\chi$. However, another calculation method may be adopted. Furthermore, the expansion coefficient $\alpha$ is determined every image display frame.

These points will now be described.

On the basis of an image signal SRGB for a (p, q)th pixel including an image signal value $x1_{(p,q)}$ corresponding to the first primary color, an image signal value $x2_{(p,q)}$ corresponding to the second primary color, and an image signal value $x3_{(p,q)}$ corresponding to the third primary color, usually saturation $S_{(p,q)}$ and value $V(S)_{(p,q)}$ in the cylindrical HSV color space are found from $$S_{(p,q)}=(Max_{(p,q)}-Min_{(p,q)}/Max_{(p,q)} \quad (5)$$

$$V(S)_{(p,q)}=Max_{(p,q)} \quad (6)$$

where $Max_{(p,q)}$ is the maximum value of the image signal value $x1_{(p,q)}$, the image signal value $x2_{(p,q)}$, and the image signal value $x3_{(p,q)}$ included in the image signal SRGB, $Min_{(p,q)}$ is the minimum value of the image signal value $x1_{(p,q)}$, the image signal value $x2_{(p,q)}$, and the image signal value $x3_{(p,q)}$, the saturation S has a value in the range of 0 to 1, and the value V(S) has a value in the range of 0 to $(2^n-1)$, where n is a display gradation bit number.

A color filter is not disposed between the fourth subpixel 49W which displays white and an observer of an image. If the first subpixel 49R which displays the first primary color, the second subpixel 49G which displays the second primary color, the third subpixel 49B which displays the third primary color, and the fourth subpixel 49W which displays the fourth color are lighted at the same lighting level, then the fourth subpixel 49W is brighter than the first subpixel 49R, the second subpixel 49G, and the third subpixel 49B. It is assumed that when a signal value corresponding to the maximum value of display signal values corresponding to the first subpixels 49R is inputted to a first subpixel 49R, a signal value corresponding to the maximum value of display signal values corresponding to the second subpixels 49G is inputted to a second subpixel 49G, and a signal value corresponding to the maximum value of display signal values corresponding to the third subpixels 49B is inputted to a third subpixel 49B, the luminance of a set of a first subpixel 49R, a second subpixel 49G, and a third subpixel 49B included in a pixel 48 or the luminance of a set of first subpixels 49R, second subpixels 49G, and third subpixels 49B included in a group of pixels 48 is $BN_{1-3}$. Furthermore, it is assumed that when a signal value corresponding to the maximum value of display signal values corresponding to a fourth subpixel 49W included in a pixel 48 or fourth subpixels 49W included in a group of pixels 48 is inputted to a fourth subpixel 49W, the luminance of the fourth subpixel 49W is $BN_4$. That is to say, white which has the maximum luminance is displayed by a set of a first subpixel 49R, a second subpixel 49G, and a third subpixel 49B and the luminance of white is $BN_{1-3}$. As a result, the constant $\chi$ which depends on the display device 10 is expressed as $$\chi=BN_4/BN_{1-3}$$

By the way, if the display signal value $X4_{(p,q)}$ is given by the above expression (4), the maximum value Vmax(S) of a value, in which the saturation S in the reproduction HSV color space is a variable, is expressed as:

If $S\leq S_0$, then $$V\max(S)=(\chi+1)\cdot(2^n-1) \quad (7)$$

If $S_0\leq S\leq 1$, then $$V\max(S)=(2^n-1)\cdot(1/S) \quad (8)$$

where $S_0=1/(\chi+1)$.

The maximum value Vmax(S) of a value in which the saturation S in the reproduction HSV color space that has been extended by adding the fourth color is a variable and which is obtained in this way is stored in, for example, the signal processing section 20 as a type of lookup table. Alternatively, the maximum value Vmax(S) of a value in which the saturation S in the reproduction HSV color space is a variable is found every time by the signal processing section 20.

The expansion coefficient $\alpha$ is used for expanding the value V(S) in the HSV color space into the reproduction HSV color space and is expressed as $$\alpha(S)=V\max(S)/V(S) \quad (9)$$

In expansion calculation, the expansion coefficient $\alpha$ is determined on the basis of, for example, $\alpha(S)$ found for plural pixels 48.

Expansion calculation is performed so that the ratio among the luminance of the first primary color displayed by (first subpixel 49R+fourth subpixel 49W), the luminance of the second primary color displayed by (second subpixel 49G+fourth subpixel 49W), and the luminance of the third primary color displayed by (third subpixel 49B+fourth subpixel 49W) will be held, so that a color tone will be held (maintained), and so that a gradation-luminance characteristic (gamma ($\gamma$) characteristic) will be held (maintained). Furthermore, if all image signal values are 0 or small for a pixel 48 or a group of pixels 48, then the expansion coefficient $\alpha$ may be calculated with the pixel 48 or the group of pixels 48 excluded.

The display signal conversion unit 22 analyzes an image signal SRGB on the basis of the above procedure and calculates the expansion coefficient $\alpha$. The display signal conversion unit 22 calculates the expansion coefficient $\alpha$ for each pixel. On the basis of at least one of expansion coefficients $\alpha$ calculated for pixels in an arbitrary area, the display signal conversion unit 22 determines the expansion coefficient $\alpha$ in the arbitrary area. An arbitrary area may be a pixel or the entire display surface. The display signal conversion unit 22 then converts the image signal SRGB to a display signal SRGBW by the use of expressions (1), (2), (3), and (4). The display signal conversion unit 22 corrects the display signal SRGBW after conversion according to the luminance of the backlight 50 for a corresponding area. That is to say, the expansion coefficient $\alpha$ is an embodiment of the conversion coefficient.

The image analysis unit 23 analyzes the image signal SRGB according to blocks on the basis of the above procedure and calculates the expansion coefficient α for each block. A required luminance value required for each block is 1/α which is the reciprocal of the expansion coefficient α.

As has been described, by using the expansion coefficient α for performing division drive control of the backlight 50 and display control of the image display panel 30, the luminance of the backlight 50 is set to a minimum value by which the display device 10 can perform color reproduction in the reproduction HSV color space. As a result, the power consumption of the display device 10 is reduced.

The processes performed by the tentative lighting level calculation unit 25 and the lighting level determination unit 26 will now be described by the use of a concrete example illustrated in FIG. 9.

Figure 9:
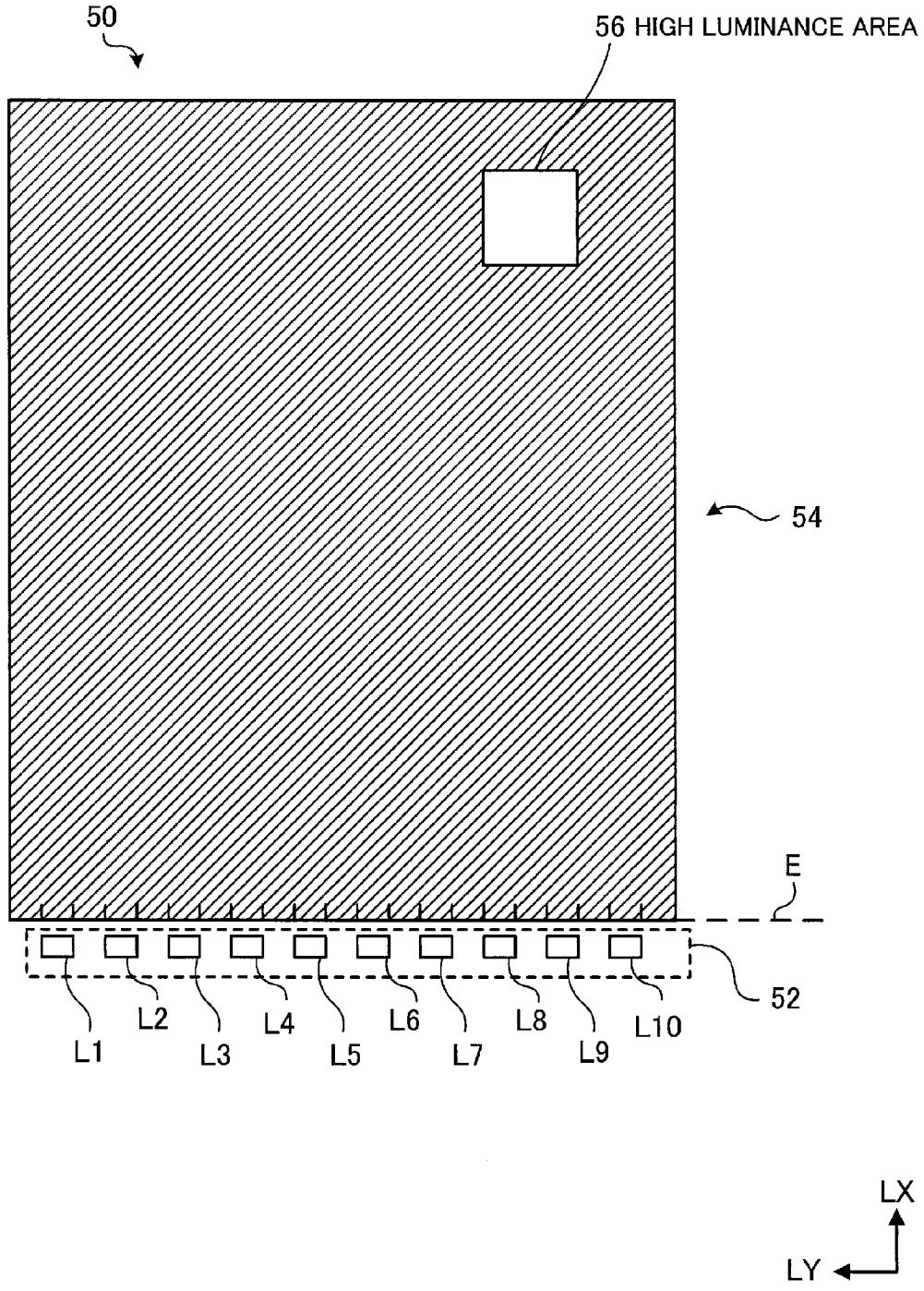
FIG. 9 illustrates an example of the luminance distribution of an image signal.

FIG. 9 illustrates an example of the luminance distribution of an image signal.

FIG. 9 illustrates luminance distribution detected on the display surface on which an image signal SRGB at a point of time is displayed. There is a high luminance area 56 on the display surface whose luminance is higher than that of the other areas. Control is performed so as to make the luminance of the corresponding area on the backlight 50 high. In the example of FIG. 9, it is assumed that the display surface is divided into blocks by division lines which extend in the LX direction and that a division line is drawn between two adjacent light sources Ln and L(n+1). Accordingly, the blocks correspond to the light sources L. For example, blocks including the high luminance area 56 correspond to the light sources L8 and L9.

Each light source L included in the sidelight light source 52 will be described. The reproduction HSV color space which is illustrated in FIG. 8 and which can be reproduced by the display device 10 is realized by expanding the cylindrical HSV color space in the value direction. Accordingly, luminance included in usage conditions for a light source L in the reproduction HSV color space which can be reproduced by the display device 10 is higher than luminance included in usage conditions for a light source L in the cylindrical HSV color space based on the three primary colors. As a result, usage conditions for each light source L are changed. For example, it is assumed that usage conditions for a light source L in the cylindrical HSV color space are an LED peak current of 20 mA and the maximum pulse width modulation (PWM) value 100 percent (%). Hereinafter these conditions will be referred to as the reference conditions. For example, an LED peak current of 40 mA and the maximum PWM value 100% are set as usage conditions for a light source L in the reproduction HSV color space which can be reproduced by the display device 10. With the display device 10 a PWM value required for obtaining the same luminance that is realized on the reference conditions is half of a PWM value included in the reference conditions. For example, the same luminance that is realized at the maximum PWM value 100% included in the reference conditions is obtained at the PWM value 50% in the display device 10.

The required luminance value 1/α calculated by the image analysis unit 23 by analyzing the image signal SRGB is inputted to the tentative lighting level calculation unit 25. On the basis of a required luminance value for each block, the tentative lighting level calculation unit 25 determines a tentative lighting level of each light source L so as to satisfy the required luminance value.

FIG. 10 illustrates an example of tentative lighting level information.

Tentative lighting level information 70 is an example of a tentative lighting level calculated by the tentative lighting level calculation unit 25. A tentative lighting level is set for each of the light sources L1 through L10. "Lighting Rate (%)" is a PWM value. "PWM Ratio" is the ratio of luminance or an LED current value in use corresponding to a luminance or an LED current value in the reference conditions. For example, a PWM ratio is obtained by dividing a lighting rate in use by a lighting rate of 50% which obtains the same luminance or current as that of the reference conditions. On the other hand, the current of 20 mA is obtained under the reference condition in which the LED peak current is 20 mA and the PMW value is 100%. In the case of L8 in FIG. 10 for example, an LED peak current is 40 mA and "Lighting Rate(%)" or PWM vale is 100%, and then 40 mA is obtained in LED. In the case of L8 in FIG. 10, the same current as that of reference condition, 20 mA, is obtained when an LED peak current is 40 mA and PWM value is 50%. In this case PWM ratio of 2.0 is obtained by dividing 100% by 50%.

In the example of FIG. 10, the light source L8 (lighting rate is 100 and a PWM ratio is 2.00) and the light source L9 (lighting rate is 97 and a PWM ratio is 1.94) exceeds 1.0 indicative of the same luminance that is realized at the maximum PWM value 100% included in the reference conditions. Furthermore, the PWM ratios of the light sources L8 and L9 are higher than those of the other light sources L1 through L7 and L10. That is to say, a heavy load is imposed on the light source L8 or L9. Such a state is a factor in a decrease in the lifetime of a light source.

With the display device 10 an upper limit value is set for a lighting rate so as not to impose a heavy load on a light source L. An upper limit value is set in a predetermined range. For example, an upper limit value is set in the range between a lighting rate which does not cause the luminance below the maximum luminance obtained by an image signal SRGB and a lighting rate corresponding to a peak value of drive current by which a light source L is driven. Image signal values included in the image signal SRGB fluctuate. In the second embodiment, however, an upper limit value is set on the basis of the maximum luminance obtained by the image signal SRGB. In the examples of FIGS. 9 and 10, an upper limit value is in the range between 50% corresponding to the maximum PWM value 100% of the reference conditions and 100% corresponding to an LED peak current of 40 mA. An upper limit value is set properly. However, an upper limit value is set according to an average current value determined by a peak current value and a lighting rate of a light source L.

In the following description the upper limit value of a lighting rate is set to 62.5%. If a lighting rate is 62.5%, then the ratio of this lighting rate to the maximum PWM value 100% included in the reference conditions is 1.25.

A process performed by the lighting level determination unit 26 on the above conditions will be described by the use of FIGS. 11 through 14.

Figure 11:
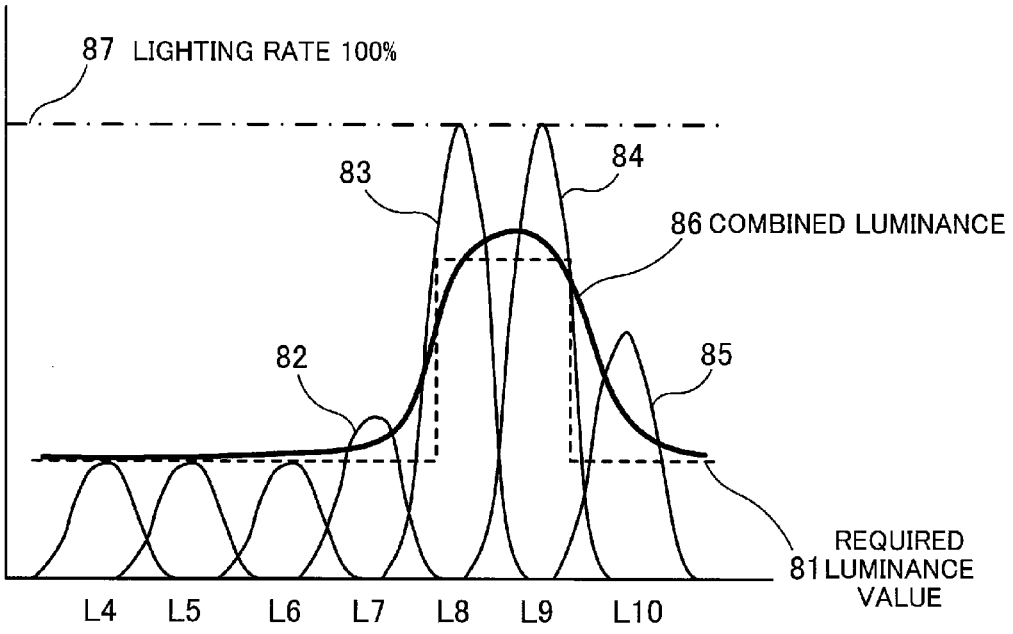
FIG. 11 illustrates luminance distribution detected at the time of lighting each light source at a tentative lighting level.

The tentative lighting level information 70 illustrated in FIG. 10 is inputted to the lighting level determination unit 26. FIG. 11 illustrates luminance distribution detected at the time of lighting each light source at a tentative lighting level.

FIG. 11 illustrates luminance distribution in the LY direction in an area of the backlight 50 illustrated in FIG. 9. FIG. 11 illustrates luminance distribution for the light sources L4 through L10. Luminance distribution for the light sources L1 through L3 is omitted. The same applies to FIGS. 12 through 14.

A required luminance value 81 indicated by a dashed line in FIG. 11 is a required luminance value calculated by the image analysis unit 23 for a block. A solid line indicates luminance distribution for each light source L. In particular, the luminance distribution for the light sources L7 through L10 is marked with numbers. Hereinafter the luminance distribution for the light sources L7, L8, L9, and L10 will be indicated by luminance 82, 83, 84, and 85 respectively. Combined luminance 86 indicates luminance distribution obtained by combining the luminance distribution for the light sources L4 through L10. The lighting rate 100% marked with the number 87 and indicated by a dot-dash line indicates the upper limit of luminance at the time of lighting a light source L at a lighting rate of 100%.

As illustrated in FIG. 11, if the light sources L4 through L10 are lighted at the tentative lighting levels indicated in the tentative lighting level information 70 illustrated in FIG. 10, the luminance 83 of the light source L8 and the luminance 84 of the light source L9 are high and close to a lighting rate of 100%. The lighting level determination unit 26 has set the upper limit value of a lighting rate to 62.5%, so the lighting rates of the light sources L8 and L9 exceed the upper limit value. Accordingly, the lighting rates of the light sources L8 and L9 are limited to 62.5%.

Figure 12:
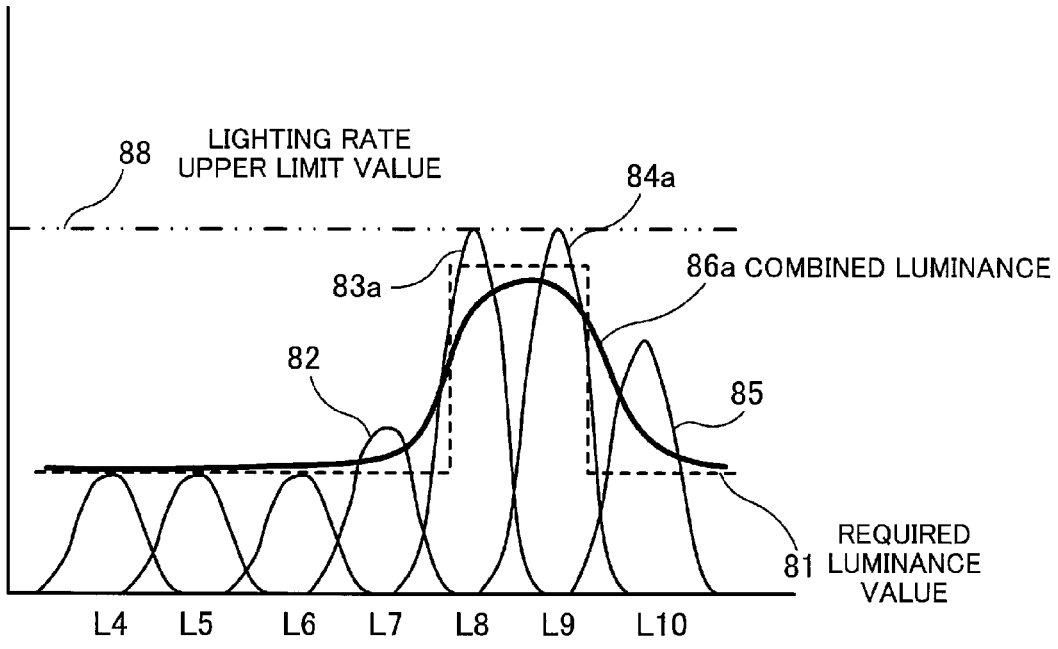
FIG. 12 illustrates luminance distribution detected at the time of limiting a lighting level of a light source by an upper limit value.

FIG. 12 illustrates luminance distribution detected at the time of limiting a lighting level of a light source by an upper limit value.

A lighting rate upper limit value 88 indicated in FIG. 12 by a chain double-dashed line indicates the upper limit of luminance at the time of lighting a light source L at a lighting rate of 62.5%. As illustrated in FIG. 12, lighting levels of the light sources L8 and L9 are limited to the upper limit value. Accordingly, the maximum value of luminance 83*a* of the light source L8 and the maximum value of luminance 84*a* of the light source L9 decrease. As a result, combined luminance 86*a* is lower than the required luminance value 81. The lighting level determination unit 26 performs a lighting level determination process in order in one direction parallel to the direction (LY direction) in which the light sources L are arranged in the sidelight light source 52. In the example of FIG. 12, the lighting level determination unit 26 corrects a tentative lighting level of a light source L next to a light source L whose tentative lighting level is limited from the leftmost light source L4 to the rightmost light source L10 in the sidelight light source 52 illustrated in FIG. 9. That is to say, the lighting level determination unit 26 considers the light source L10 adjacent to the light source L9 on the right side as a light source whose tentative lighting level is to be corrected, and calculates a lighting level which satisfies a required luminance value for a block corresponding to the light sources L8 and L9. When a calculated lighting rate of the light source L10 exceeds the upper limit value, the lighting level determination unit 26 limits a lighting rate of the light source L10 to the upper limit value.

Figure 13:
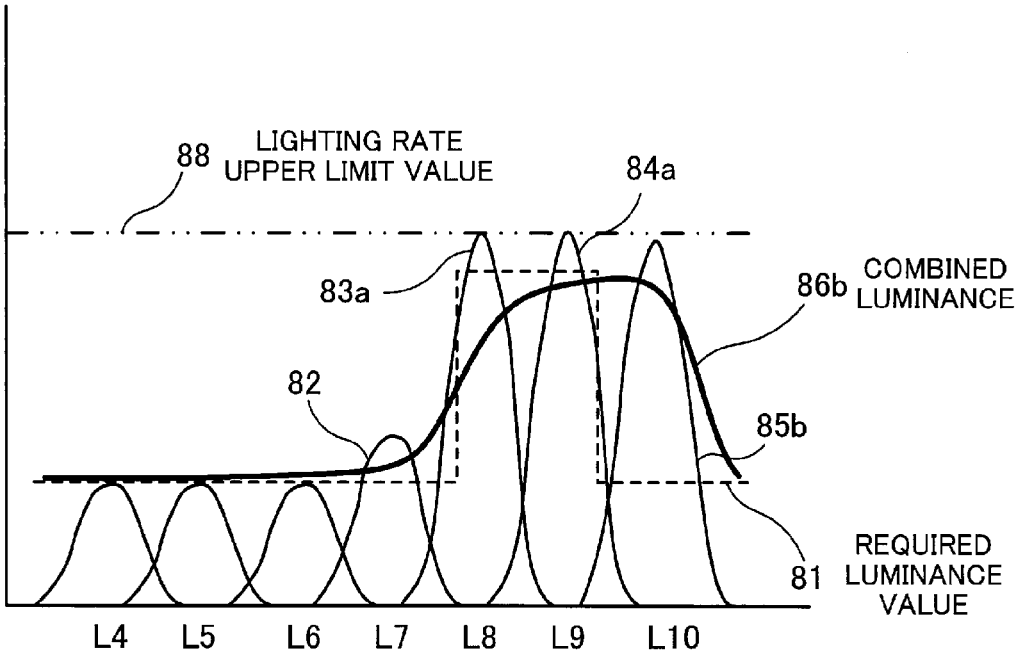
FIG. 13 illustrates luminance distribution detected at the time of increasing a lighting level of a next light source on the right side.

FIG. 13 illustrates luminance distribution detected at the time of increasing a lighting level of the next light source on the right side.

In the example of FIG. 13, a calculated lighting rate of the light source L10 which compensates for a reduction in the luminance of the light sources L8 and L9 exceeds the lighting rate upper limit value 88, so a lighting rate of the light source L10 is limited to the upper limit value. Furthermore, combined luminance 86*b* increases with an increase in the maximum value of luminance 85*b* of the light source L10. However, the combined luminance 86*b* is still lower than the required luminance value 81. The lighting level determination unit 26 searches for a light source next to the light source L10 in the direction from the light source L4 to the light source L10. However, there is no light source next to the light source L10 in this direction, so the process in this direction ends. Next, the lighting level determination unit 26 searches in the opposite direction for a light source whose tentative lighting level is to be corrected. In the example of FIG. 13, the lighting level determination unit 26 makes a search in order in the direction from the light source L10 to the light source L4 and detects the light source L7 adjacent to the light source L8 on the left side as a light source whose tentative lighting level is to be corrected. The lighting level determination unit 26 calculates a lighting level which satisfies the required luminance value for the block corresponding to the light sources L8 and L9 and determines a lighting level of the light source L7 according to the calculated lighting level. This is the same with the light source L10.

Figure 14:
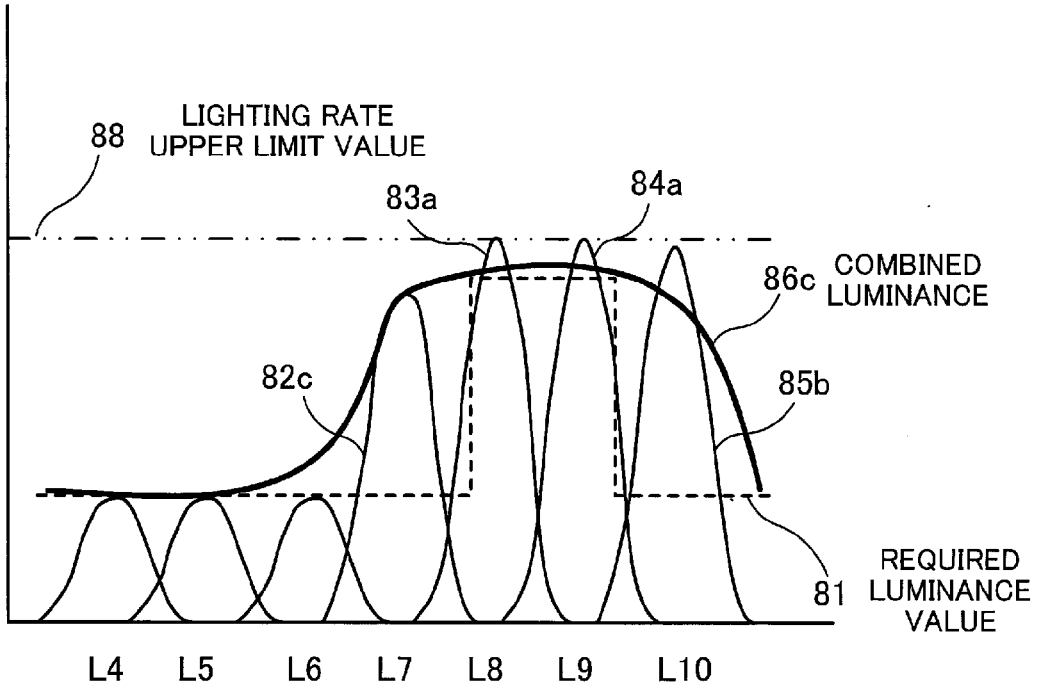
FIG. 14 illustrates luminance distribution detected at the time of increasing a lighting level of a next light source on the left side.

FIG. 14 illustrates luminance distribution detected at the time of increasing a lighting level of a next light source on the left side.

As illustrated in FIG. 14, the maximum value of luminance 82*c* of the light source L7 increases because its lighting level is larger than a tentative lighting level as a result of a correction. As a result, combined luminance 86*c* satisfies the required luminance value 81.

The combined luminance 86*c* satisfies the required luminance value 81, so the tentative lighting levels of the light sources L1 through L6 which are not corrected are set as lighting levels. As a result, lighting levels of all the light sources L are determined.

FIG. 15 illustrates an example of lighting level information.

As indicated in lighting level information 71, lighting rates of the light sources L8 and L9 are limited to 62.5% which is the upper limit value. On the other hand, a lighting rate of the light source L10 adjacent to the light source L9 on the right side rises to 62.5% and a lighting rate of the light source L7 adjacent to the light source L8 on the left side rises to 52%. As has been described, at the time when the tentative lighting levels are calculated, a heavy load is imposed on each of the light sources L8 and L9. However, lighting levels of the light sources L8 and L9 are reduced and the light source L7 adjacent to the light source L8 on the left side and the light source L10 adjacent to the light source L9 on the right side compensate for a reduction in luminance. By doing so, the load on each of the light sources L8 and L9 is reduced.

As has been described, in the second embodiment a heavy load on a light source L is reduced. This reduces deterioration of the light source L. In addition, surrounding light sources compensate for lack of luminance caused by limiting lighting levels. As a result, the luminance distribution of the backlight 50 satisfies a required luminance value. Accordingly, it is possible to prevent deterioration of a light source without degrading image quality.

A procedure for a backlight control process performed by the display device 10 will now be described by the use of FIGS. 16 through 19.

Figure 16:
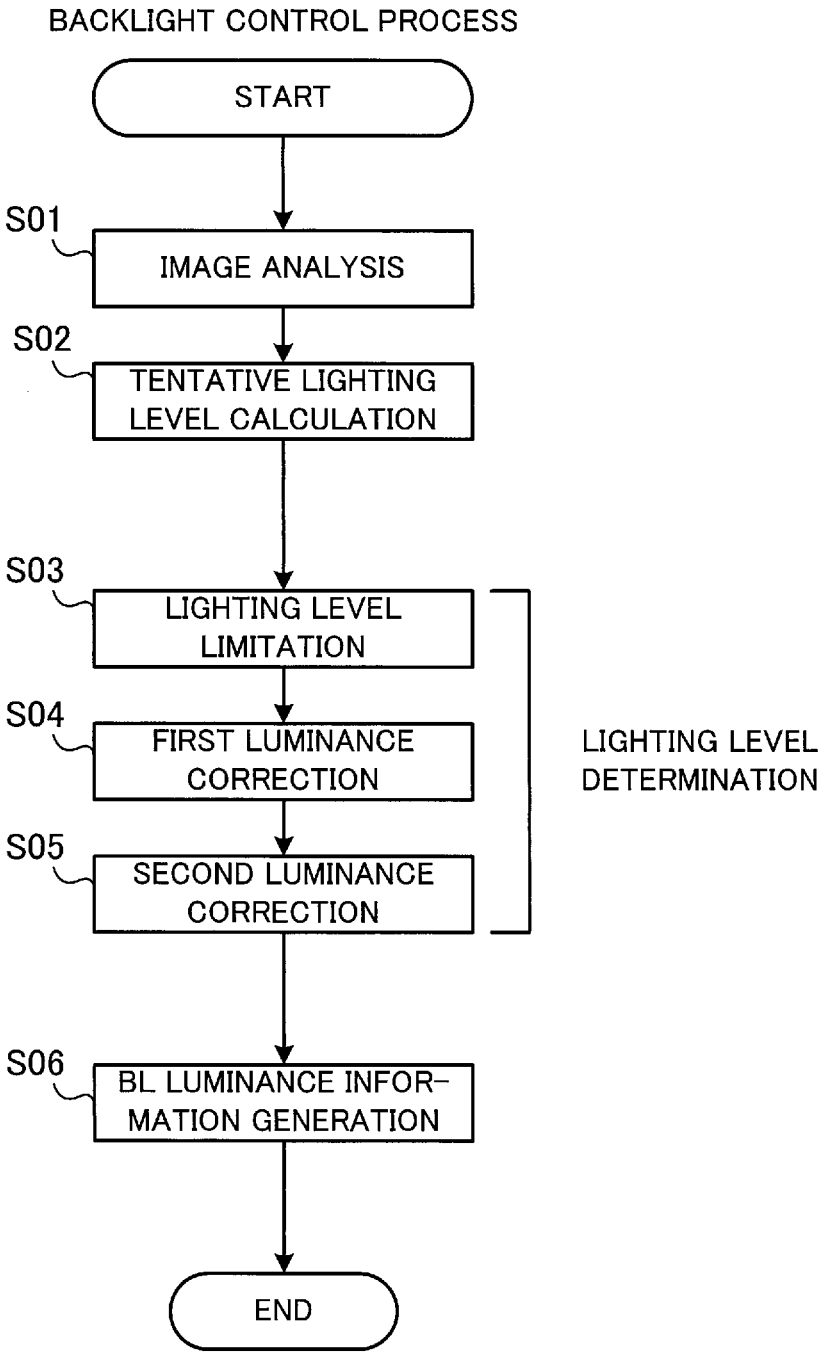
FIG. 16 is a flow chart of a procedure for a backlight control process.

FIG. 16 is a flow chart of a procedure for a backlight control process.

An image signal SRGB is inputted every image frame cycle from the image output section 11 to the signal processing section 20. When input of the image signal SRGB is begun, the signal processing section 20 begins a process and outputs the image signal SRGB to the timing generation unit 21, the display signal conversion unit 22, and the image analysis unit 23.

(Step S01) The image analysis unit 23 analyzes the acquired image signal SRGB and calculates a required luminance value for each block. For example, the image analysis unit 23 analyzes the image signal SRGB corresponding to each block and calculates 1/α.

(Step S02) On the basis of the required luminance value calculated in step S01 and the light-source-specific LUT 240 stored in the light source data storage unit 24, the tentative lighting level calculation unit 25 calculates a tentative lighting level of each light source L which satisfies the required luminance value.

(Step S03) The lighting level determination unit 26 performs in order three steps S03, S04, and S05 to determine a lighting level of each light source L. In the first stage, the lighting level determination unit 26 limits a lighting level. To be concrete, the lighting level determination unit 26 detects a light source L whose tentative lighting level exceeds an upper limit value, and limits a lighting level of the detected light source L to the upper limit value.

(Step S04) The lighting level determination unit 26 performs first luminance correction as the second stage. To be concrete, the lighting level determination unit 26 performs luminance correction in one direction in which the light sources L are arranged in the sidelight light source 52. In this example, a tentative lighting level of a light source L corresponding to a block on the right side of a block corresponding to the light source L whose lighting level is limited to the upper limit value is to be corrected in the rightward direction in FIG. 9, that is to say, in the direction from the light source L1 to the light source L10. In the example of FIG. 9, a light source L corresponding to a block on the right side of a block corresponding to the light source L whose lighting level is limited to the upper limit value is a light source L adjacent on the right side to the light source L whose lighting level is limited to the upper limit value. This correction compensates for a reduction in the entire luminance caused by the lighting level limitation in step S03.

(Step S05) The lighting level determination unit 26 performs second luminance correction as the third stage. To be concrete, a tentative lighting level of a light source L corresponding to a block on the left side of the block corresponding to the light source L whose lighting level is limited to the upper limit value is to be corrected in the leftward direction opposite to the direction in step S04, that is to say, in the direction from the light source L10 to the light source L1. By doing so, the lighting level determination unit 26 corrects luminance for the block from a side on which a reduction in luminance is not compensated for by the first luminance correction in step S04. Furthermore, a tentative lighting level of a light source L on which the lighting level limitation, the first luminance correction, or the second luminance correction is not performed is considered as a lighting level. As a result, all lighting level signals SBL are generated. The lighting level determination unit 26 outputs the generated all lighting level signals SBL to the light source drive section 60.

(Step S06) The lighting level determination unit 26 generates on the basis of the generated all lighting level signals SBL and the light-source-specific LUT 240 BL luminance information indicative of the luminance distribution of the backlight 50 at the time of lighting the sidelight light source 52 with the generated all lighting level signals SBL, and outputs the BL luminance information to the display signal conversion unit 22. On the basis of the BL luminance information, the display signal conversion unit 22 corrects a display signal SRGBW obtained by converting the image signal SRGB. By doing so, a display signal SRGBW suited to the luminance of the corresponding backlight 50 is generated.

The lighting level limitation, the first luminance correction, and the second luminance correction will now be described in detail. In the following description, a light source corresponding to a block to be processed is indicated by a light source Ln, a light source corresponding to the next block on the right side is indicated by a light source L(n+1), and a light source corresponding to the next block on the left side is indicated by a light source L(n−1).

Figure 17:
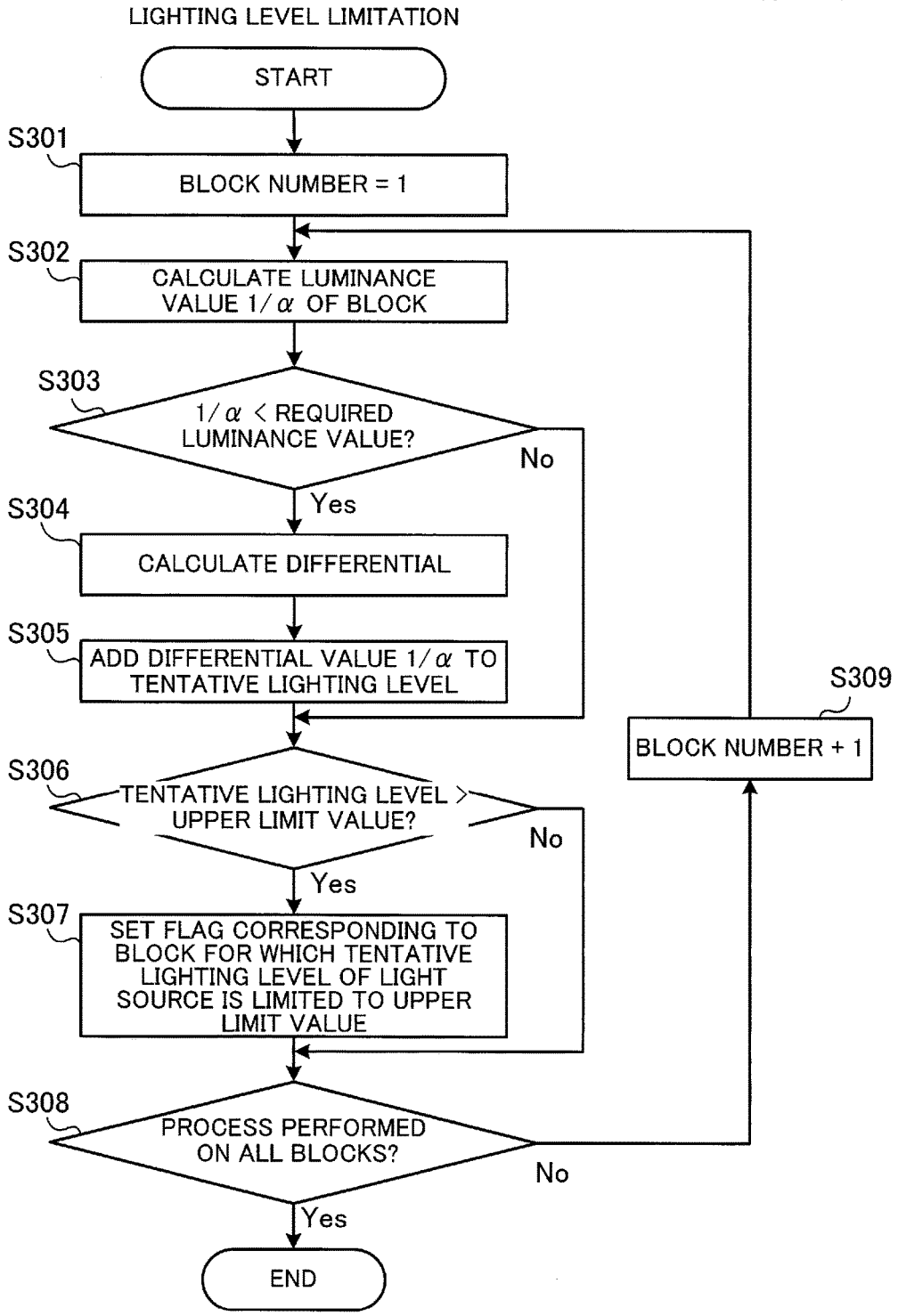
FIG. 17 is a flow chart of a procedure for lighting level limitation in lighting level determination.

FIG. 17 is a flow chart of a procedure for the lighting level limitation in the lighting level determination.

(Step S301) The lighting level determination unit 26 initializes a block number to 1 to perform a process on a block-by-block basis. As stated above, a block area corresponds to a light source Ln.

(Step S302) On the basis of the light-source-specific LUT 240, the lighting level determination unit 26 calculates the luminance value 1/α of a block detected at the time of lighting the light source Ln corresponding to the block at a tentative lighting level.

(Step S303) The lighting level determination unit 26 determines whether or not the luminance value 1/α of the block which is detected at the time of lighting the light source Ln at the tentative lighting level and which is calculated in step S302 is smaller than the required luminance value 1/α. If the calculated luminance value 1/α of the block is smaller than the required luminance value, then the lighting level determination unit 26 determines that the luminance value 1/α of the block does not satisfy the required luminance value, and proceeds to step S304. If the calculated luminance value 1/α of the block is greater than or equal to the required luminance value, then the lighting level determination unit 26 determines that the luminance value 1/α of the block satisfies the required luminance value, and proceeds to step S306.

(Step S304) If the luminance value 1/α of the block is smaller than the required luminance value, then the lighting level determination unit 26 calculates the differential between them. On the basis of the light-source-specific LUT 240, the lighting level determination unit 26 then calculates the number of times the differential is greater than a luminance value in the position obtained from the light-source-specific LUT 240. A calculated value corresponds to the differential value 1/α.

(Step S305) The lighting level determination unit 26 adds the differential value 1/α calculated in step S304 to the tentative lighting level of the light source Ln corresponding to the block to update the tentative lighting level.

(Step S306) The lighting level determination unit 26 compares a tentative lighting level of the light source Ln corresponding to the block with an upper limit value to determine whether or not the tentative lighting level is larger than the upper limit value. If the tentative lighting level is larger than the upper limit value, then the lighting level determination unit 26 proceeds to step S307. If the tentative lighting level is smaller than or equal to the upper limit value, then the lighting level determination unit 26 proceeds to step S308.

(Step S307) The tentative lighting level is larger than the upper limit value, so the lighting level determination unit 26 limits a tentative lighting level of the light source Ln to the upper limit value. Furthermore, the lighting level determination unit 26 sets a flag corresponding to the block in limitation information indicative of blocks for which tentative lighting levels of light sources are limited to the upper limit value.

(Step S308) The lighting level determination unit 26 determines whether or not a process has been performed on all blocks. If there is a block on which a process has not been performed yet, then the lighting level determination unit 26 proceeds to step S309. If a process has been performed on all the blocks, then the lighting level determination unit 26 ends the lighting level limitation.

(Step S309) The lighting level determination unit 26 increments the block number by one and returns to step S302.

By performing the above procedure, a lighting level of a light source L whose tentative lighting level exceeds the upper limit value is limited to the upper limit value. Furthermore, a flag indicative of limitation information is set for a block for which a lighting level of a light source L is limited to the upper limit value to pass the limitation information to the next process.

The first luminance correction will now be described.

Figure 18:
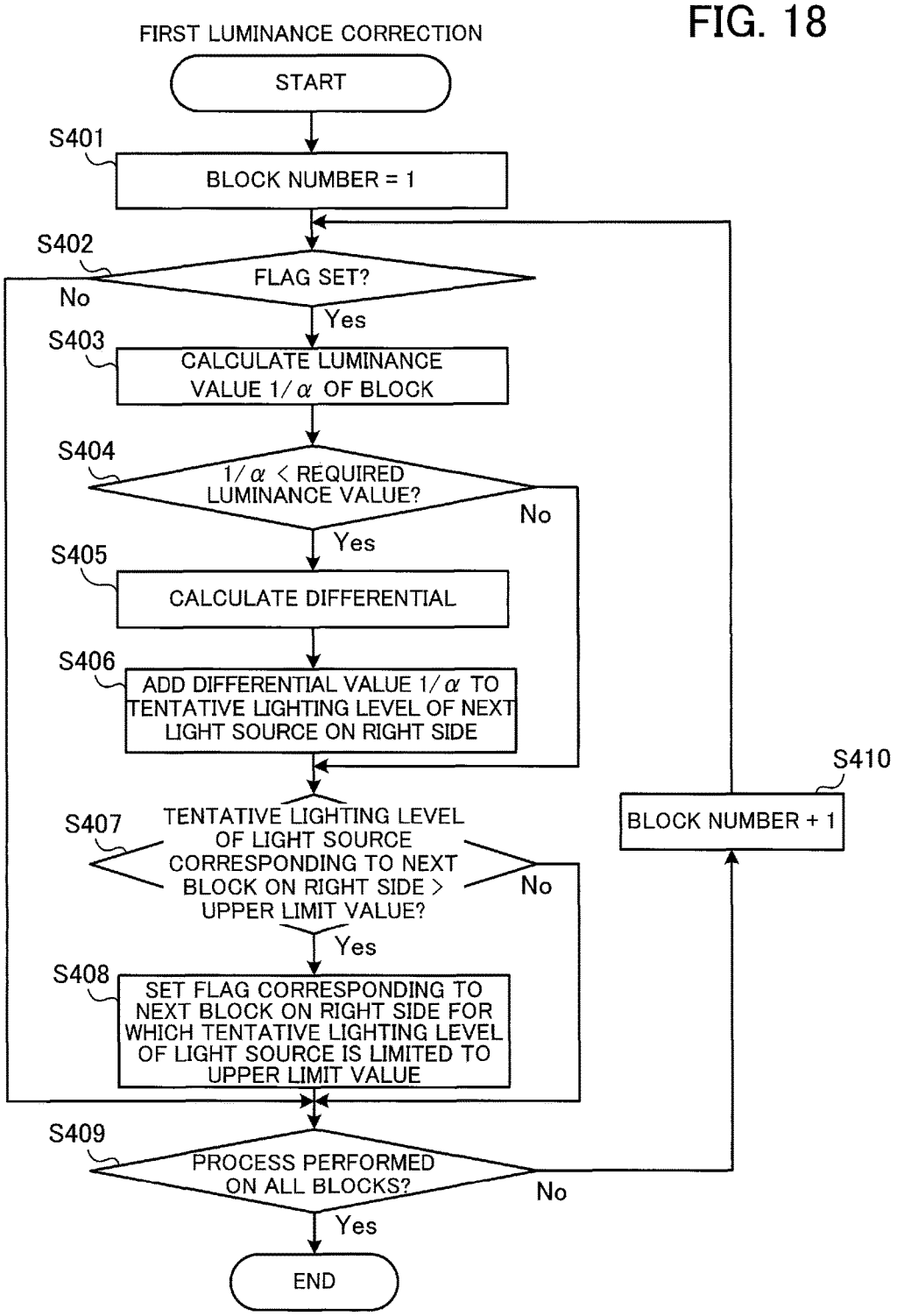
FIG. 18 is a flow chart of a procedure for first luminance correction in the lighting level determination.

FIG. 18 is a flow chart of a procedure for the first luminance correction in the lighting level determination.

(Step S401) The lighting level determination unit 26 initializes a block number to 1.

(Step S402) The lighting level determination unit 26 refers to the limitation information set in the lighting level limitation illustrated in FIG. 17, and determines whether or not a flag corresponding to the block is set. If a flag is set, that is to say, a lighting level of the light source Ln corresponding to the block is limited, then the lighting level determination unit 26 proceeds to step S403. If a flag is not set, that is to say, a lighting level of the light source Ln corresponding to the block is not limited, then the lighting level determination unit 26 proceeds to step S409.

(Step S403) A flag corresponding to the block is set, so the lighting level determination unit 26 calculates on the basis of the light-source-specific LUT 240 the luminance value $1/\alpha$ of the block detected at the time of lighting the light source Ln corresponding to the block at a limited lighting level.

(Step S404) The lighting level determination unit 26 determines whether or not the luminance value $1/\alpha$ of the block calculated in step S403 is smaller than the required luminance value $1/\alpha$. If the calculated luminance value $1/\alpha$ of the block is smaller than the required luminance value, then the lighting level determination unit 26 determines that the luminance value $1/\alpha$ of the block does not satisfy the required luminance value, and proceeds to step S405. If the calculated luminance value $1/\alpha$ of the block is greater than or equal to the required luminance value, then the lighting level determination unit 26 determines that the luminance value $1/\alpha$ of the block satisfies the required luminance value, and proceeds to step S407.

(Step S405) If the luminance value $1/\alpha$ of the block is smaller than the required luminance value, then the lighting level determination unit 26 calculates the differential between them. On the basis of the light-source-specific LUT 240, the lighting level determination unit 26 then calculates the number of times the differential is greater than a luminance value in the position of a block adjacent on the right side to the above block obtained from the light-source-specific LUT 240. A calculated value corresponds to the differential value $1/\alpha$.

(Step S406) The lighting level determination unit 26 adds the differential value $1/\alpha$ calculated in step S405 to a tentative lighting level of the light source L(n+1) corresponding to the block adjacent on the right side to the above block to update the tentative lighting level.

(Step S407) The lighting level determination unit 26 compares a tentative lighting level after update of the light source L(n+1) corresponding to the block adjacent on the right side to the above block with the upper limit value to determine whether or not the tentative lighting level after update is larger than the upper limit value. If the tentative lighting level after update is larger than the upper limit value, then the lighting level determination unit 26 proceeds to step S408. If the tentative lighting level after update is smaller than or equal to the upper limit value, then the lighting level determination unit 26 proceeds to step S409.

(Step S408) The tentative lighting level after update is larger than the upper limit value, so the lighting level determination unit 26 limits a tentative lighting level of the light source L(n+1) to the upper limit value. Furthermore, the lighting level determination unit 26 sets a flag corresponding to the next block on the right side in the limitation information indicative of blocks for which tentative lighting levels of light sources are limited to the upper limit value.

(Step S409) The lighting level determination unit 26 determines whether or not a process has been performed on all the blocks. If there is a block on which a process has not been performed yet, then the lighting level determination unit 26 proceeds to step S410. If a process has been performed on all the blocks, then the lighting level determination unit 26 ends the first luminance correction.

(Step S410) The lighting level determination unit 26 increments the block number by one and returns to step S402.

By performing the above procedure, a lighting level is corrected in order from a light source corresponding to a block adjacent on the right side to a block for which a tentative lighting level of a light source exceeds an upper limit value. If a lighting level after correction exceeds the upper limit value, then luminance is corrected by a light source corresponding to next block but one on the right side. A lighting level correction is repeated in this way until a light source whose tentative lighting level does not exceed the upper limit value is detected or until the last light source.

The second luminance correction will now be described.

Figure 19:
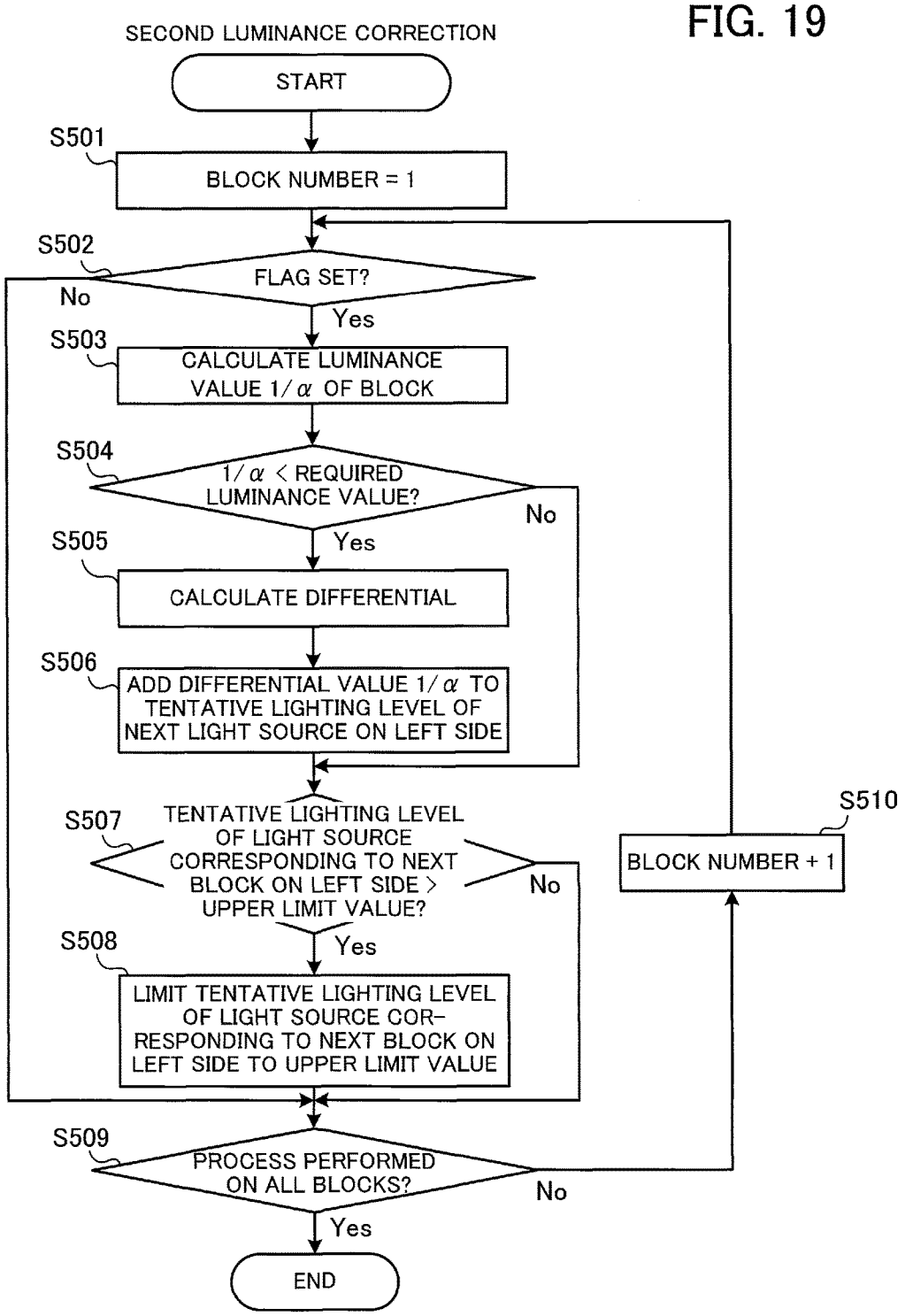
FIG. 19 is a flow chart of a procedure for second luminance correction in the lighting level determination.

FIG. 19 is a flow chart of a procedure for the second luminance correction in the lighting level determination.

(Step S501) The lighting level determination unit 26 initializes a block number to 1.

(Step S502) The lighting level determination unit 26 refers to the limitation information and determines whether or not a flag corresponding to the block is set. If a flag is set, that is to say, a lighting level of the light source Ln corresponding to the block is limited, then the lighting level determination unit 26 proceeds to step S503. If a flag is not set, that is to say, a lighting level of the light source Ln corresponding to the block is not limited, then the lighting level determination unit 26 proceeds to step S509.

(Step S503) A flag corresponding to the block is set, so the lighting level determination unit 26 calculates on the basis of the light-source-specific LUT 240 the luminance value $1/\alpha$ of the block detected at the time of lighting the light source Ln corresponding to the block at a limited lighting level.

(Step S504) The lighting level determination unit 26 determines whether or not the luminance value $1/\alpha$ of the block calculated in step S503 is smaller than the required luminance value $1/\alpha$. If the calculated luminance value $1/\alpha$ of the block is smaller than the required luminance value, then the lighting level determination unit 26 determines that the luminance value $1/\alpha$ of the block does not satisfy the required luminance value, and proceeds to step S505. If the calculated luminance value $1/\alpha$ of the block is greater than or equal to the required luminance value, then the lighting level determination unit 26 determines that the luminance value $1/\alpha$ of the block satisfies the required luminance value, and proceeds to step S507.

(Step S505) If the luminance value $1/\alpha$ of the block is smaller than the required luminance value, then the lighting level determination unit 26 calculates the differential between them. On the basis of the light-source-specific LUT 240, the lighting level determination unit 26 then calculates the number of times the differential is greater than a luminance value in the position of a block adjacent on the left side to the above block obtained from the light-source-specific LUT 240. A calculated value corresponds to the differential value $1/\alpha$.

(Step S506) The lighting level determination unit 26 adds the differential value $1/\alpha$ calculated in step S505 to a tentative lighting level of the light source L(n−1) corresponding to the block adjacent on the right side to the above block to update the tentative lighting level.

(Step S507) The lighting level determination unit 26 compares a tentative lighting level after update of the light source L(n−1) corresponding to the block adjacent on the left side to the above block with the upper limit value to determine whether or not the tentative lighting level after update is larger than the upper limit value. If the tentative lighting level after update is larger than the upper limit value, then the lighting level determination unit 26 proceeds to step S508. If the tentative lighting level after update is smaller than or equal to the upper limit value, then the lighting level determination unit 26 proceeds to step S509.

(Step S508) The tentative lighting level after update is larger than the upper limit value, so the lighting level determination unit 26 limits a tentative lighting level of the light source L(n−1) to the upper limit value.

(Step S509) The lighting level determination unit 26 determines whether or not a process has been performed on all the blocks. If there is a block on which a process has not been performed yet, then the lighting level determination unit 26 proceeds to step S510. If a process has been performed on all the blocks, then the lighting level determination unit 26 ends the second luminance correction.

(Step S510) The lighting level determination unit 26 increments the block number by one and returns to step S502.

By performing the above procedure, a lighting level is corrected in order from a light source corresponding to a block adjacent on the left side to a block for which a tentative lighting level of a light source exceeds an upper limit value.

As has been described, a reduction in the luminance of the backlight 50 caused by limiting a lighting level of the light source Ln to an upper limit value is compensated for by surrounding light sources and a lighting level which satisfies a required luminance value is determined. If a lighting level of a light source corresponding to a block adjacent on the left side to a block for which a tentative lighting level of a light source exceeds the upper limit value also exceeds the upper limit value, then luminance is corrected by a light source corresponding to next block but one on the left side. This is the same with the first luminance correction. A lighting level correction is repeated in this way until a light source whose tentative lighting level does not exceed the upper limit value is detected.

With the above procedures, corrections are made in order in both directions in which the light sources L are arranged, and the process ends. However, the same procedures may be performed again. Furthermore, the same process may be performed not only in the leftward and rightward directions (LY direction in FIG. 9) but also in the upward and downward directions (LX direction in FIG. 9) perpendicular to the leftward and rightward directions, depending on the arrangement of light sources or a method for making a division into blocks.

The above processing functions can be realized with a computer. In that case, a program in which the contents of the functions that the display device has are described is provided. By executing this program on the computer, the above processing functions are realized on the computer. This program may be recorded on a computer readable record medium. A computer readable record medium may be a magnetic storage device, an optical disk, a magneto-optical recording medium, a semiconductor memory, or the like. A magnetic storage device may be a hard disk drive (HDD), a flexible disk (FD), a magnetic tape, or the like. An optical disk may be a digital versatile disc (DVD), a DVD-random access memory (RAM), a compact disc read only memory (CD-ROM), a CD-recordable (R)/rewritable (RW), or the like. A magneto-optical recording medium may be a magneto-optical disk (MO) or the like.

To place the program on the market, portable record media, such as DVDs or CD-ROMs, on which it is recorded are sold. Alternatively, the program is stored in advance in a storage unit of a server computer and is transferred from the server computer to another computer via a network.

When a computer executes this program, it will store the program, which is recorded on a portable record medium or which is transferred from the server computer, in, for example, its storage unit. Then the computer reads the program from its storage unit and performs processes in compliance with the program. The computer may read the program directly from a portable record medium and perform processes in compliance with the program. Furthermore, each time the program is transferred from the server computer connected via a network, the computer may perform processes in order in compliance with the program it receives.

In addition, at least a part of the above processing functions may be realized by an electronic circuit such as a digital signal processor (DSP), an application specific integrated circuit (ASIC), or a programmable logic device (PLD).

According to one aspect, there is provided a display device including: an image display panel whose display is controlled on the basis of an image signal; a backlight which includes a plurality of light sources and which lights the image display panel from behind; and a display control section which calculates on the basis of the image signal a required luminance value of the backlight for each area obtained by dividing a display surface of the image display panel, which calculates a tentative lighting level of each of the plurality of light sources on the basis of luminance distribution information for the backlight stored in advance and the required luminance value, which sets the lighting level of a first light source whose tentative lighting level exceeds a determined upper limit value to the upper limit value, which calculates and determines the lighting level of a second light source whose tentative lighting level does not exceed the upper limit value on the basis of the lighting level of the first light source, the luminance distribution information, and the required luminance value, and which controls the backlight by the lighting levels.

In the display device, the display control section determines the lighting level of the second light source adjacent to the first light source.

Further, in the display device, the display control section compares the calculated lighting level of the second light source with the upper limit value, sets, at the time of the calculated lighting level of the second light source being larger than the upper limit value, the lighting level of the second light source to the upper limit value, and repeats determination of the lighting level of the second light source whose lighting level is not determined until the calculated lighting level of the second light source becomes smaller than or equal to the upper limit value.

Still further, in the display device, the plurality of light sources are arranged in at least one direction, and the display control section searches through the plurality of light sources in order in the one direction, detects the first light source, determines the lighting level of the first light source and a lighting level of the second light source arranged after the first light source, searches through the plurality of light sources in order in a direction opposite to the one direction, detects the first light source, and determines a lighting level of the first light source and a lighting level of the second light source arranged after the first light source.

Still further, in the display device, the image display panel includes pixels each of which includes a first subpixel which displays a first primary color, a second subpixel which displays a second primary color, a third subpixel which displays a third primary color, and a fourth subpixel which displays a fourth color, and the display control section calculates, on the basis of color information about the first primary color, the second primary color, and the third primary color included in the image signal, a conversion coefficient used for converting the image signal to a display signal by which display control of the image display panel is performed, and calculates the required luminance value on the basis of the conversion coefficient.

Still further, in the display device, the luminance of the pixels obtained by the display signal after conversion based on the conversion coefficient is higher than the luminance of the pixels obtained by the image signal, and the upper limit value is set to a value which is not lower than the maximum luminance obtained by the image signal.

In addition, according to one aspect, there is provided a method for driving a display device including an image display panel whose display is controlled on the basis of an image signal and a backlight which includes a plurality of light sources and which lights the image display panel from behind. The method includes: calculating, by a display control section, on the basis of the image signal a required luminance value of the backlight for each area obtained by dividing a display surface of the image display panel; calculating, by the display control section, a tentative lighting level of each of the plurality of light sources on the basis of luminance distribution information for the backlight stored in advance and the required luminance value; setting, by the display control section, the lighting level of a first light source whose tentative lighting level exceeds a determined upper limit value to the upper limit value and calculating and determining, by the display control section, the lighting level of a second light source whose tentative lighting level does not exceed the upper limit value on the basis of the lighting level of the first light source, the luminance distribution information, and the required luminance value; and controlling, by the display control section, the backlight by the lighting levels.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that various changes, substitutions, and alterations could be made hereto without departing from the spirit and scope of the invention.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

an image display panel whose display is controlled on the basis of an image signal;

a backlight which includes a plurality of light sources and which lights the image display panel from behind;

a luminance value calculator which calculates on the basis of the image signal, a required luminance value of the backlight for an area obtained by dividing a display surface of the image display panel;

a tentative lighting level calculator which calculates a tentative lighting level of each of the plurality of light sources on the basis of luminance distribution information for the backlight and the required luminance value;

a storage which stores the luminance distribution information; and a lighting level determiner which sets a lighting level of a first light source whose tentative lighting level exceeds a determined upper limit value to the upper limit value, which calculates and determines a lighting level of a second light source whose tentative lighting level does not exceed the upper limit value on the basis of the lighting level of the first light source, the luminance distribution information, and the required luminance value, and which controls the backlight by the lighting levels, wherein the lighting level determiner limits the lighting level of the first light source to the upper limit value and compensates for a reduction in luminance of the backlight for the divided area by increasing the lighting level of the second light source adjacent to the first light source, the luminance of the backlight being lower than the required luminance value, and wherein the reduction in the luminance of the backlight caused by limiting the lighting level of the first light source to the upper limit value is compensated for by surrounding light sources and the lighting level which satisfies the required luminance value is determined.

2. The display device according to claim 1, wherein the lighting level determiner compares the calculated lighting level of the second light source with the upper limit value, sets, at the time of the calculated lighting level of the second light source being larger than the upper limit value, the lighting level of the second light source to the upper limit value, and repeats determination of the lighting level of the second light source whose lighting level is not determined until the calculated lighting level of the second light source becomes smaller than or equal to the upper limit value.

3. The display device according to claim 1, wherein:

the plurality of light sources are arranged in at least one direction; and the lighting level determiner searches through the plurality of light sources in order in the one direction, detects the first light source, determines the lighting level of the first light source and the lighting level of the second light source arranged after the first light source, searches through the plurality of light sources in order in a direction opposite to the one direction, detects the first light source, and determines the lighting level of the first light source and the lighting level of the second light source arranged after the first light source.

4. The display device according to claim 1, wherein:

the image display panel includes pixels each including a first subpixel which displays a first primary color, a second subpixel which displays a second primary color, a third subpixel which displays a third primary color, and a fourth subpixel which displays a fourth color; and the luminance value calculator calculates, on the basis of color information about the first primary color, the second primary color, and the third primary color included in the image signal, a conversion coefficient used for converting the image signal to a display signal by which display control of the image display panel is performed, and calculates the required luminance value on the basis of the conversion coefficient.

5. The display device according to claim 4, wherein:

luminance of the pixels in the display signal after conversion based on the conversion coefficient is higher than luminance of the pixels in the image signal; and the upper limit value is set to a value which is not lower than maximum luminance obtained by the image signal.

6. A method for driving a display device including an image display panel whose display is controlled on the basis of an image signal and a backlight which includes a plurality of light sources and which lights the image display panel from behind, the method comprising:

calculating, by a luminance value calculator, on the basis of the image signal, a required luminance value of the backlight for an area obtained by dividing a display surface of the image display panel;

calculating, by a tentative lighting level calculator, a tentative lighting level of each of the plurality of light sources on the basis of luminance distribution information for the backlight and the required luminance value;

storing, by a storage, the luminance distribution information;

setting, by a lighting level determiner, a lighting level of a first light source whose tentative lighting level exceeds a determined upper limit value to the upper limit value and calculating and determining, by the lighting level determiner, a lighting level of a second light source whose tentative lighting level does not exceed the upper limit value on the basis of the lighting level of the first light source, the luminance distribution information, and the required luminance value; and controlling, by the lighting level determiner, the backlight by the lighting levels, wherein the lighting level determiner limits the lighting level of the first light source to the upper limit value and compensates for a reduction in luminance of the backlight for the divided area by increasing the lighting level of the second light source adjacent to the first light source, the luminance of the backlight being lower than the required luminance value, wherein the reduction in the luminance of the backlight caused by limiting the lighting level of the first light source to the upper limit value is compensated for by surrounding light sources and the lighting level which satisfies the required luminance value is determined.

* * * * *